United States Patent [19]

Lewis et al.

[11] 3,958,808

[45] May 25, 1976

[54] CONTROLLED CLOSING PATTERN PACKING UNIT FOR BLOWOUT PREVENTER

[75] Inventors: George E. Lewis, Arcadia; Fernando Murman, Rancho Palos Verdes, both of Calif.

[73] Assignee: Hydril Company, Los Angeles, Calif.

[22] Filed: Feb. 25, 1975

[21] Appl. No.: 552,859

Related U.S. Application Data

[62] Division of Ser. No. 483,311, June 26, 1974, Pat. No. 3,917,293.

[52] U.S. Cl. ..... 277/1

[51] Int. Cl.[2] ..... F16J 15/12

[58] Field of Search ..... 277/1, 28, 102, 113, 277/114, 120, 121, 122, 123

[56] References Cited

UNITED STATES PATENTS

| | | | |
|---|---|---|---|
| 2,368,332 | 1/1945 | Shaffer | 277/113 |
| 3,129,009 | 4/1964 | Simpson | 277/4 |
| 3,207,221 | 9/1965 | Gochran et al. | 277/2 |
| 3,225,831 | 12/1965 | Knox | 277/4 |
| 3,284,086 | 11/1966 | Primrose et al. | 277/1 |

*Primary Examiner*—Robert I. Smith
*Attorney, Agent, or Firm*—William W. Haefliger

[57] ABSTRACT

An annulus of elastomeric material in a well blowout preventer packer unit is differentially anchored about the packer axis, in order to reduce the stress levels in the elastomeric material during its inward flow toward the axis. In addition, packer inserts incorporate differently formed webs and end plates to facilitate the sought advantages.

6 Claims, 32 Drawing Figures

CONTROLLED CLOSING PATTERN PACKING UNIT FOR BLOWOUT PREVENTER

This is a division of application Ser. No. 483,311, filed June 26, 1974, and now U.S. Pat. No. 3,917,293.

BACKGROUND OF THE INVENTION

This invention relates generally to well blowout preventers, and more particularly concerns packer units used in such equipment.

For many years, the design of blowout preventer packing units has followed the principles described in U.S. Pat. No. 2,609,836 to Knox. Such units incorporate like metal inserts equally spaced about the packer central axis, and embedded by an elastomeric body. Upon inward constriction or closure of the unit about a well drill pipe, the material is anchored by insert webs as it produces vertical folds stretching radially inwardly to seal against the pipe. In general, the number of folds will equal the number of inserts, and they will be alike in circumferential contour. When the packer unit insert close on itself, with no pipe present, the elastomeric material of the folds advancing toward the axis must at certain times and places stretch or extend as much as 350 to 400%. Repeated closures produce excessive wear and fatigue of the elastomeric or rubber material, reducing the useful life of the packer due to such extreme stretching. Also, the rubber quality must be extremely closely controlled to ensure successful closure and seal-in thousands of pounds per square inch of well fluid pressure. Accordingly, there is a need for a packing unit characterized by significantly reduced rubber stretching, and the useful life of which will be extended over many more closures than conventionally possible.

Another problem with the Knox packer design has to do with damage to the rubber that tends to flow or extrude into the spaces between like end-plates on the insert webs, as the plates move relatively inwardly and toward one another during packer constriction.

SUMMARY OF THE INVENTION

It is a major object of the invention to provide a packer unit overcoming the above problems, and meeting the described needs.

Basically, the invention contemplates reducing the stress levels in the energized rubber or elastomeric pressure during its inward flow, by reducing deformation under pressure. As will appear, this is achieved in a broad sense by locating the insert webs with spacing from the central axis and from each other in such relation as to provide differential anchoring about the axis of circularly spaced portions of the elastomeric material subject to inward displacement, with resultant opening-up of rubber flow paths between the inserts. In one form of the invention, the anchoring of the rubber by certain webs is closer to the central axis than anchoring of the material by other webs; i.e., webs effectively closer to and further from the axis may alternate about that axis. In other forms of the invention, the webs may be generally equally spaced from the axis, but certain pairs of webs may have closer circular spacing about that axis than other pairs of webs.

Another object of the invention concerns the provision of differently formed or shaped end plates on the webs, and characterized as promoting or facilitating the sought advantages. In one form of the invention certain top and/or bottom plates on certain inserts are located to move closer to the central axis than other plates on other inserts, during radial constriction of the packer; further, the certain plates may be formed to interfit at their inner ends as the packer constricts, and other plates may be shaped, as for example tapered, to approach engagement with opposite sides of the interfitting plates as the packer constricts. In this regard, a method aspect of the invention may involve the steps:

a. constricting the packer to effect radially inward displacement of the inserts thereby causing interengagement of certain inserts and flow of the material between the inserts and in folds toward the pipe, and b. continuing the packer constriction to urge other inserts inwardly and relatively toward said interengaged inserts, and to further pressurize said folds of material into sealing engagement with the pipe.

Other objects include the provision of certain end plates on the insert webs that may have dovetail, or overlapping interfit at their innermost end portions; the provision of such plates with substantially parallel opposite sides directed generally inwardly toward the center region of the packer; and the provision of said certain plates in one ring shaped path and the other plates in another ring-shaped path, the two paths being concentric about the central axis.

Further objects include the provision of wedge shaped plates on the inserts and arranged circularly, certain plates being of greater circular arc dimension than other plates, and the webs integral with such plates being non-uniformly spaced, circularly, as will be seen.

Finally, the invention contemplates the angling of facing sides of adjacent plates to form a space therebetween which tapers away from the main body of packer material to minimize entrapment of and possible damage to such elastomeric material flowing into such space during packer constriction.

These and other objects and advantages of the invention, as well as the details of illustrative embodiments, will be more fully understood from the following description and drawings, in which:

DRAWING DESCRIPTION

Figure 6:
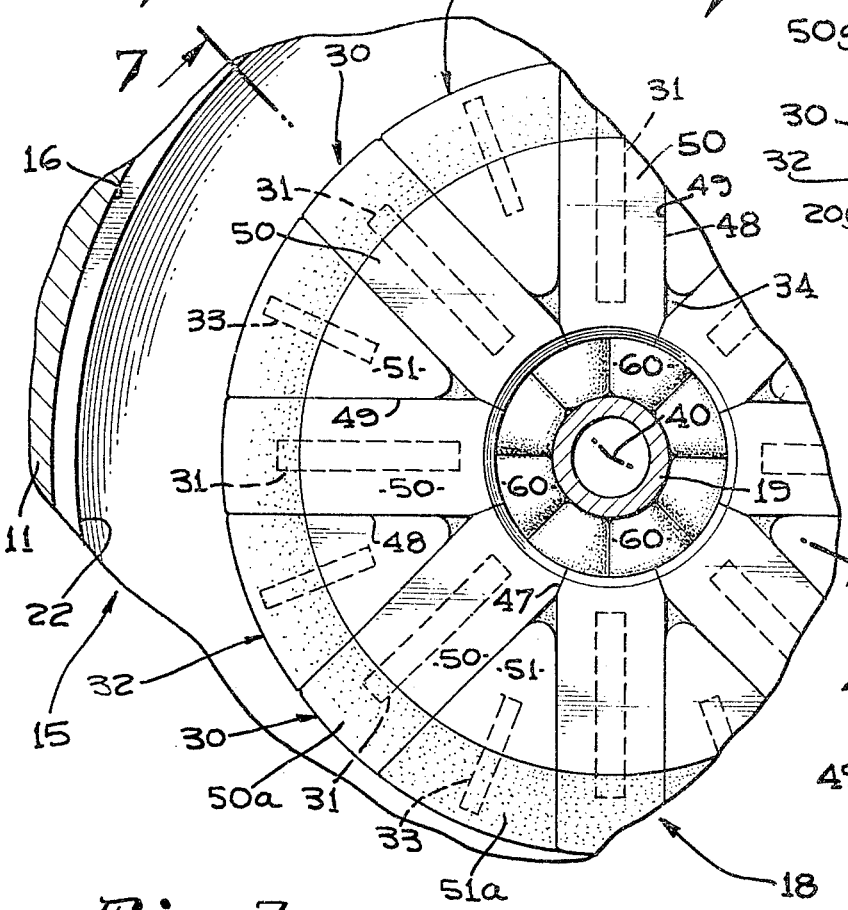
FIG. 6 is a view like FIG. 2, but showing the packer fully closed about a well pipe.
Figure 6A:
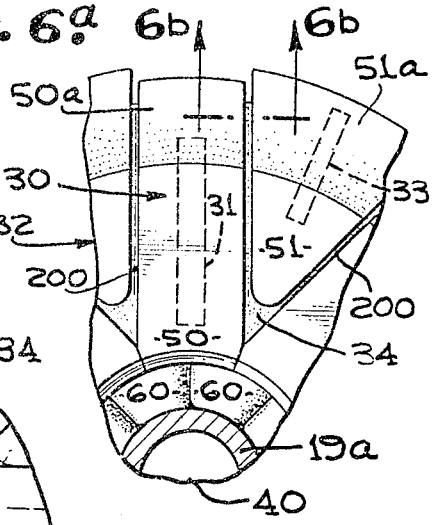
Figure 6B:
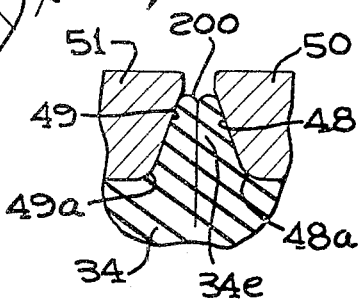

FIG. 6*a* is a fragmentary view like FIG. 6;

FIG. 6*b* is an enlarged section on lines 6*b*–6*b* of FIG. 6*a;*

Figure 8:
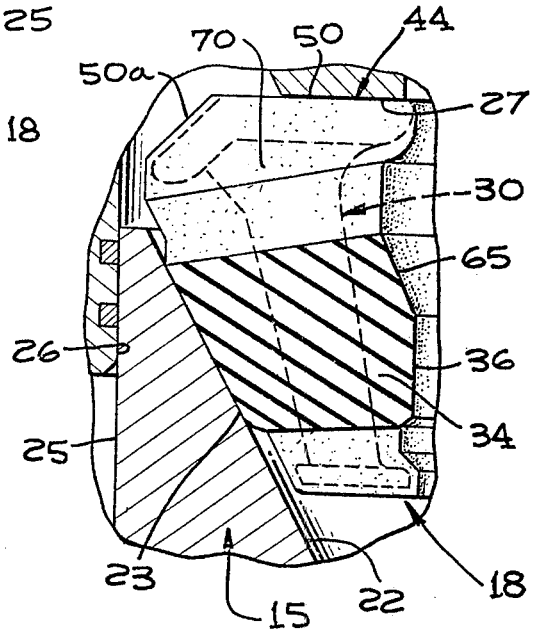
Figure 9:
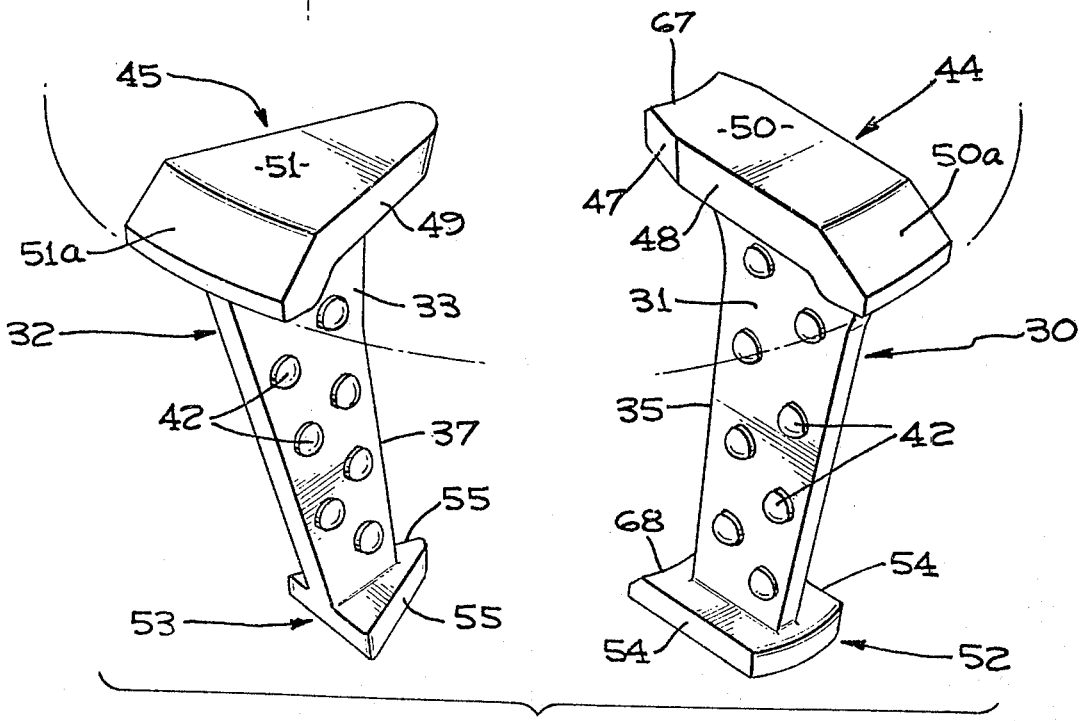
Figure 3:
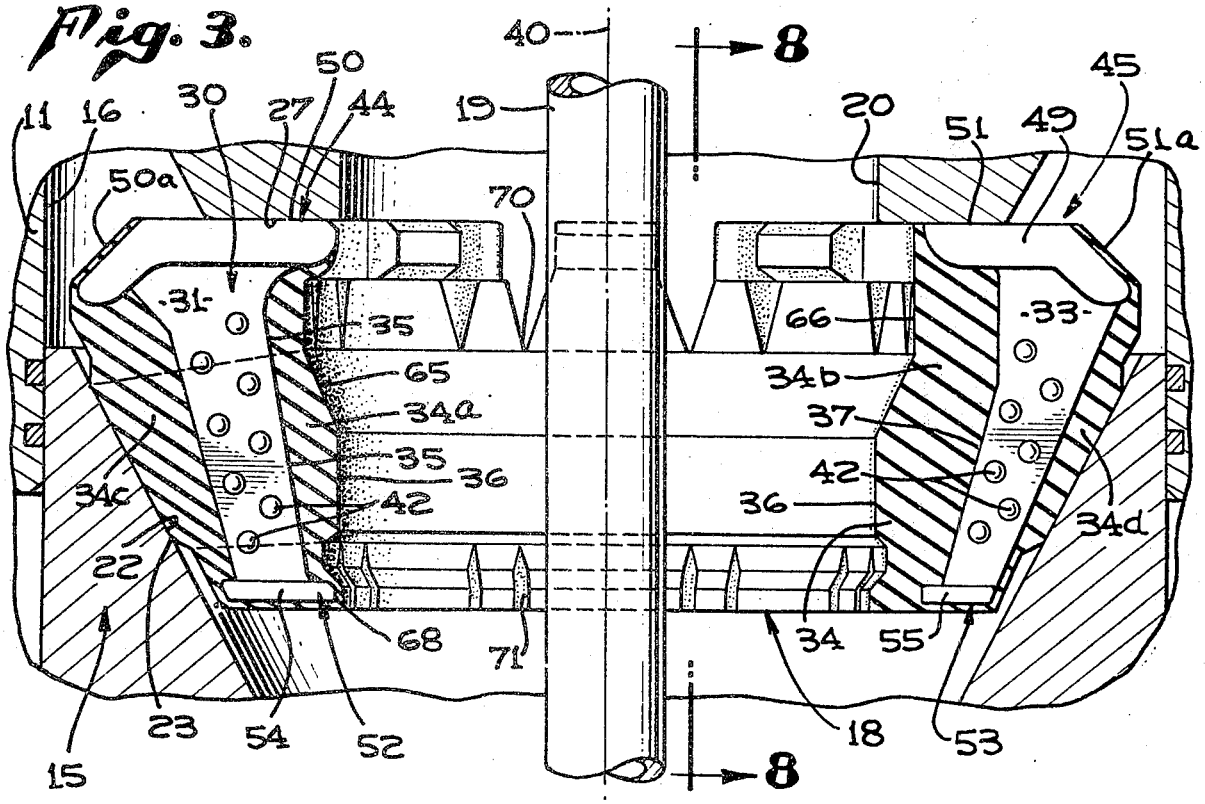
FIG. 3 is a vertical section on lines 3—3 of FIG. 2.
Figure 7:
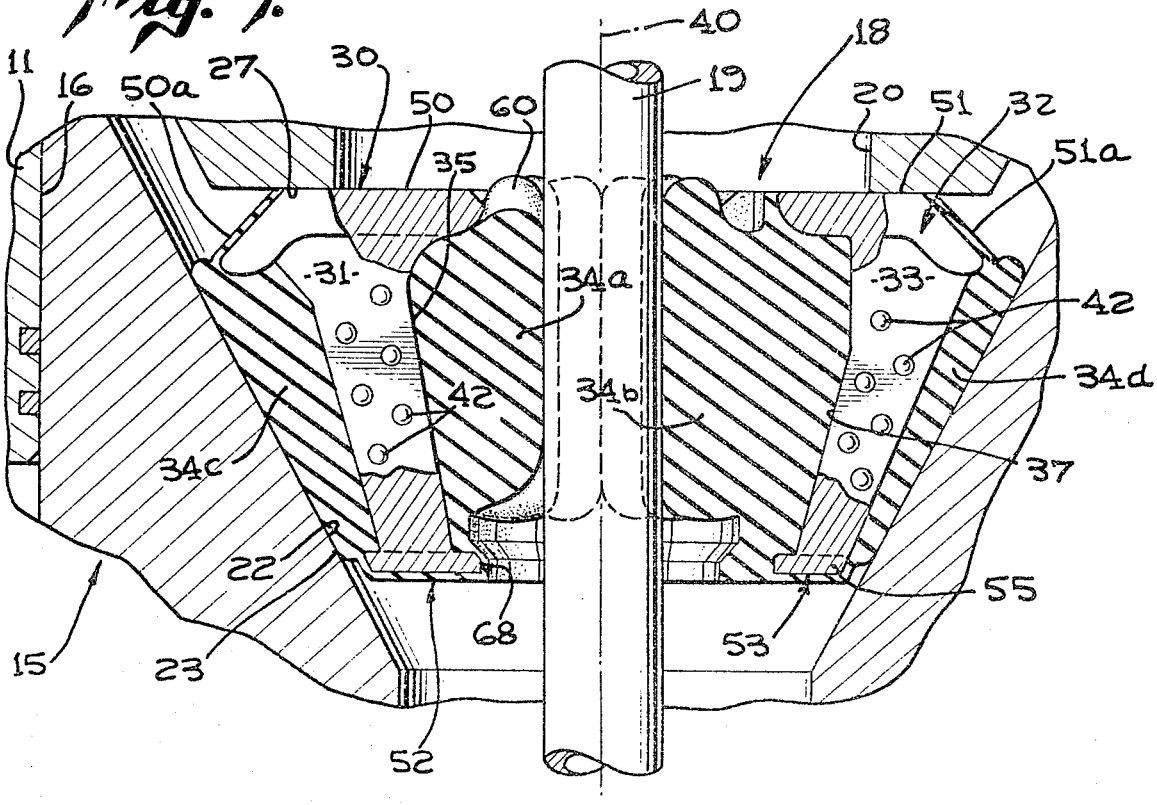
Figure 10:
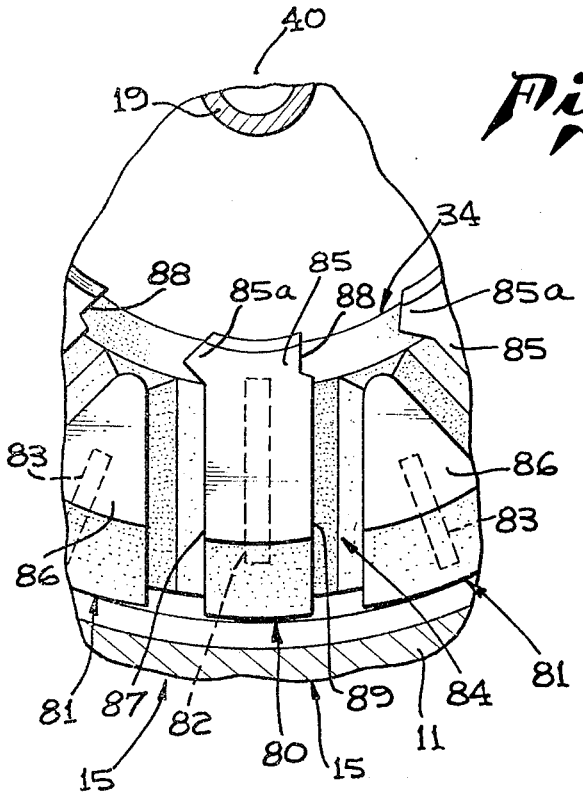
Figure 13:
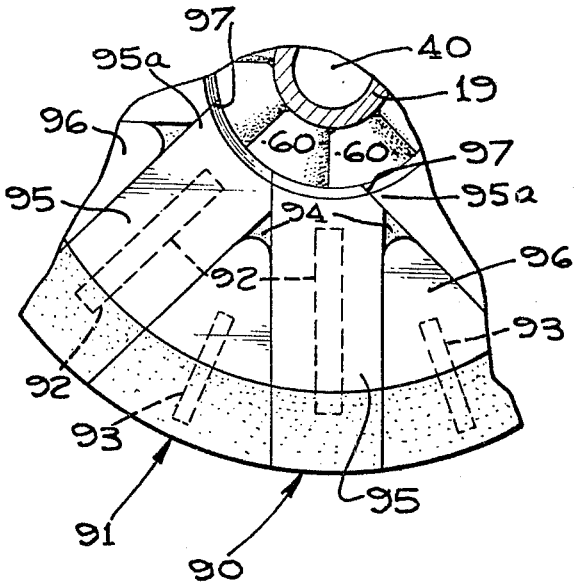
Figure 11:
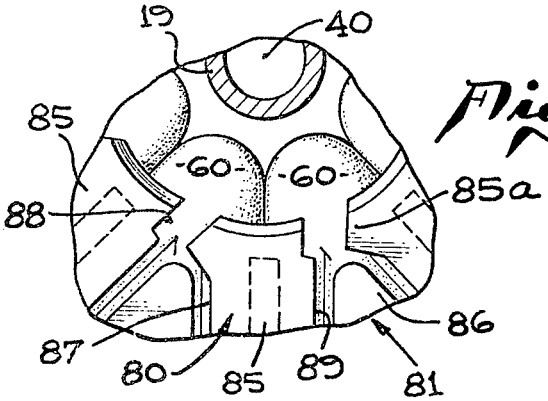
Figure 14:
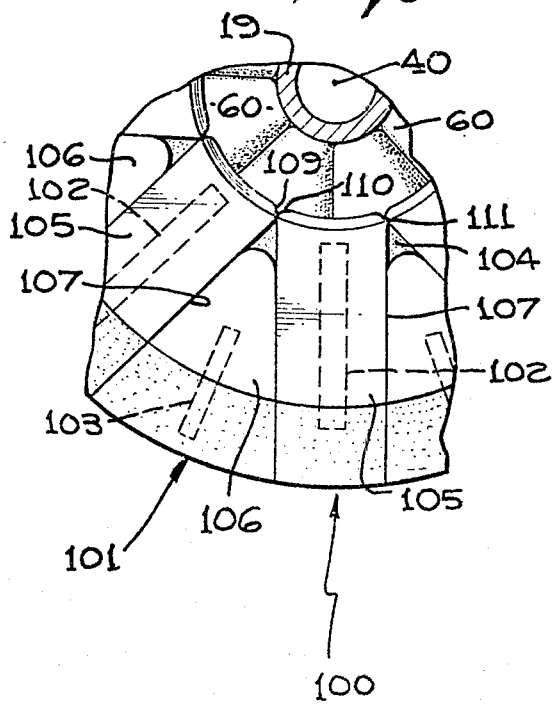
Figure 12:
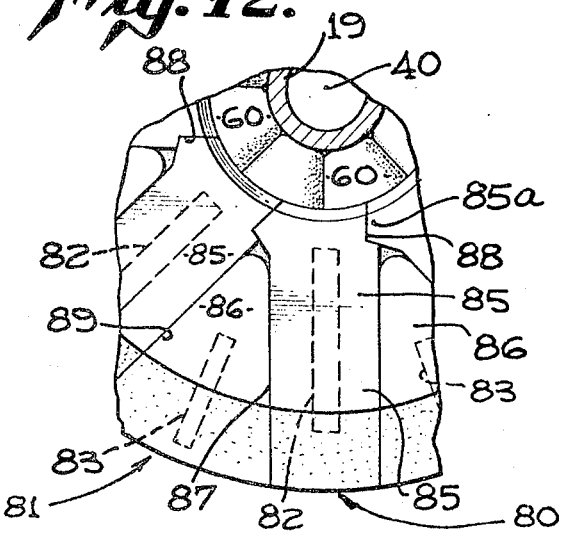
Figure 15:
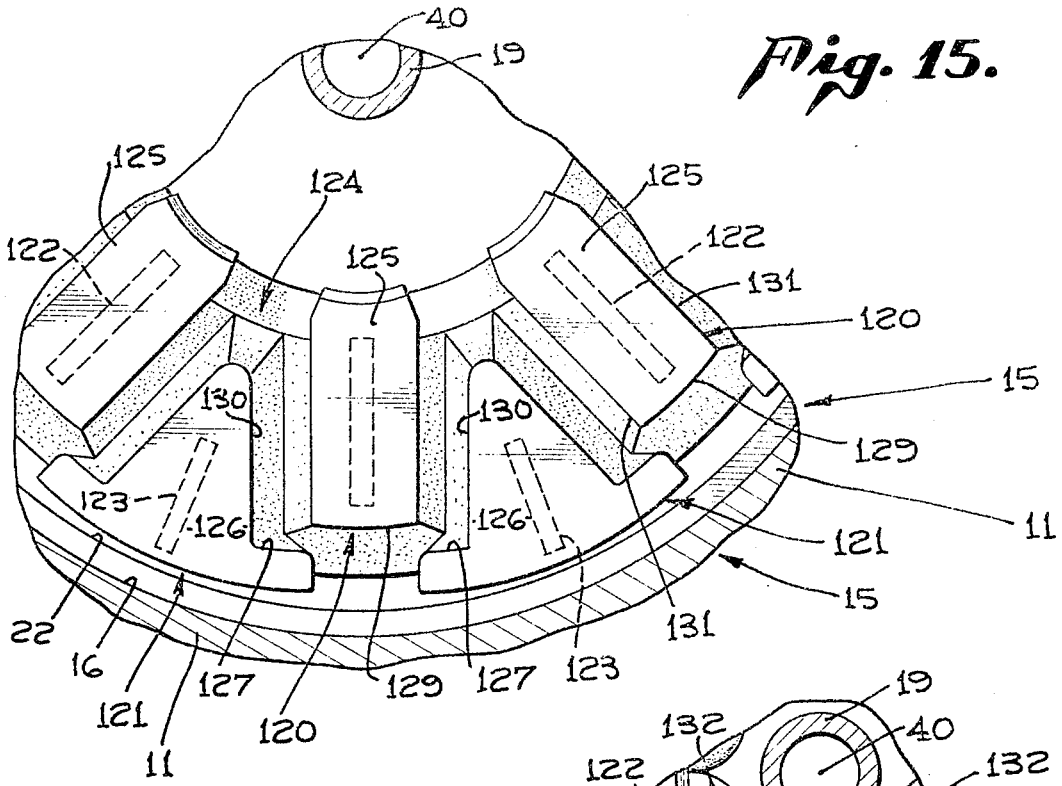
Figure 16:
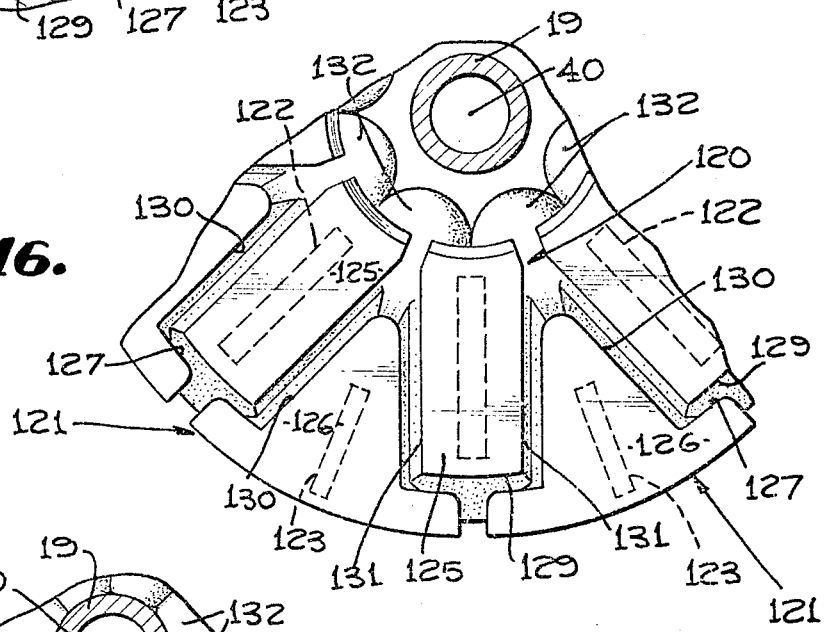
Figure 17:
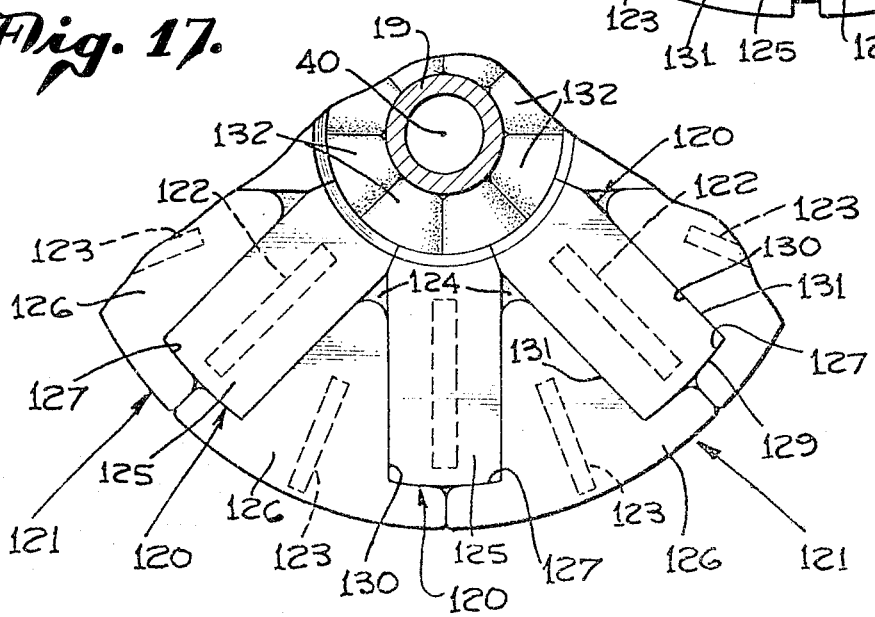
Figure 18:
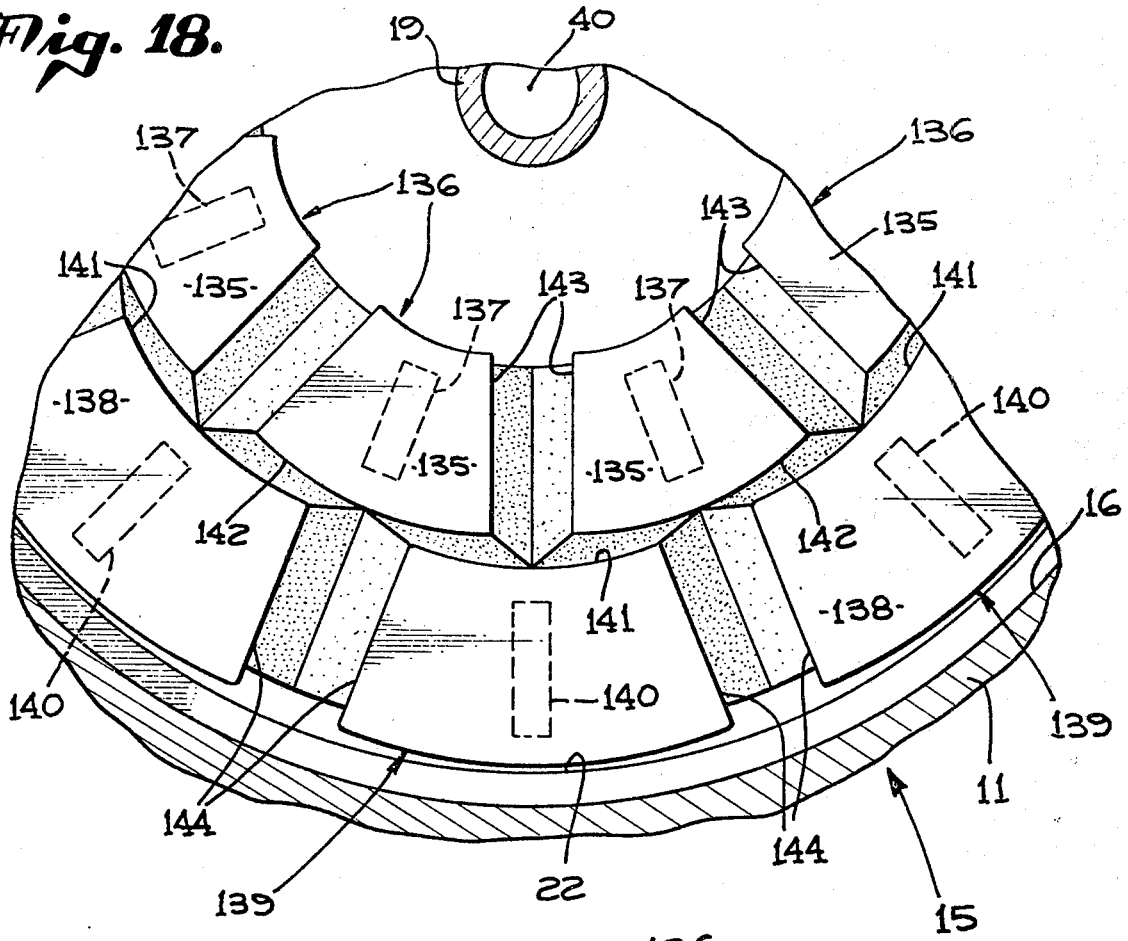
Figure 19:
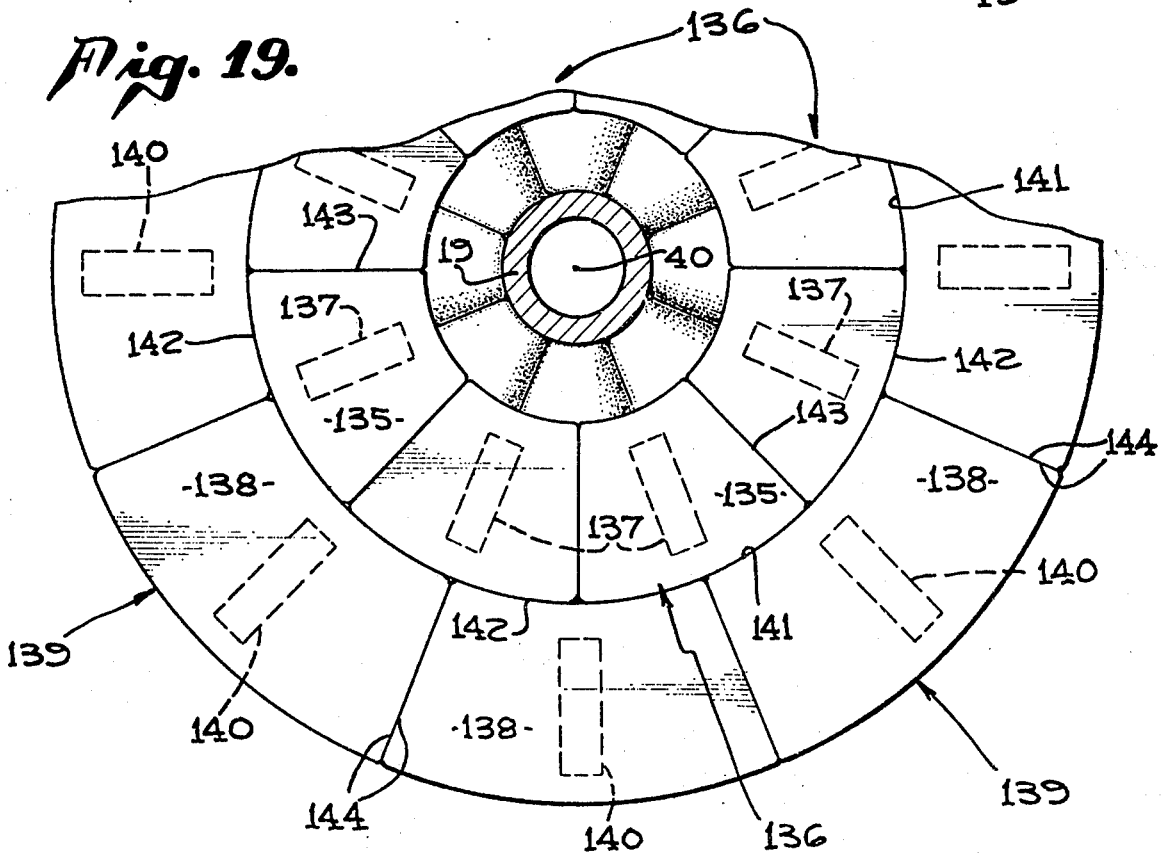
Figure 20:
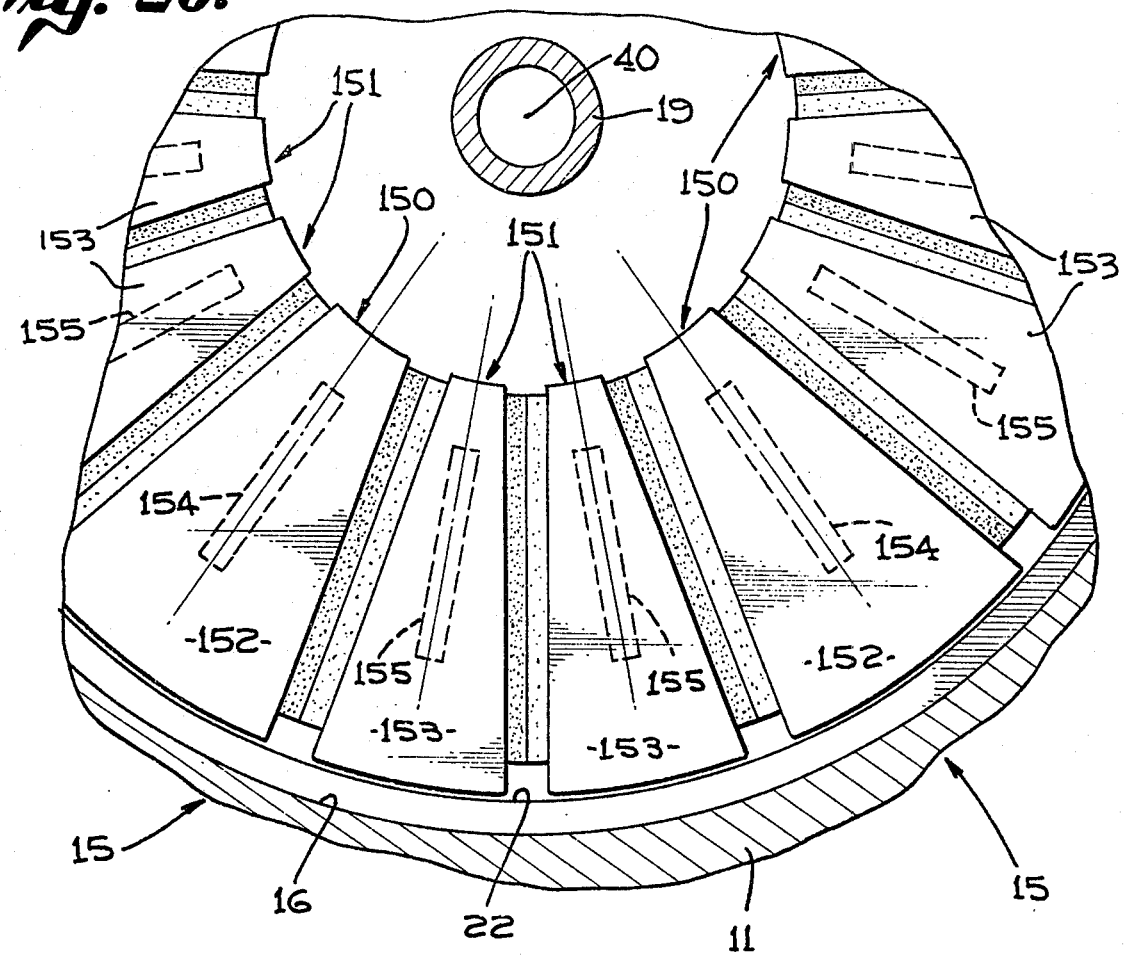
Figure 21:
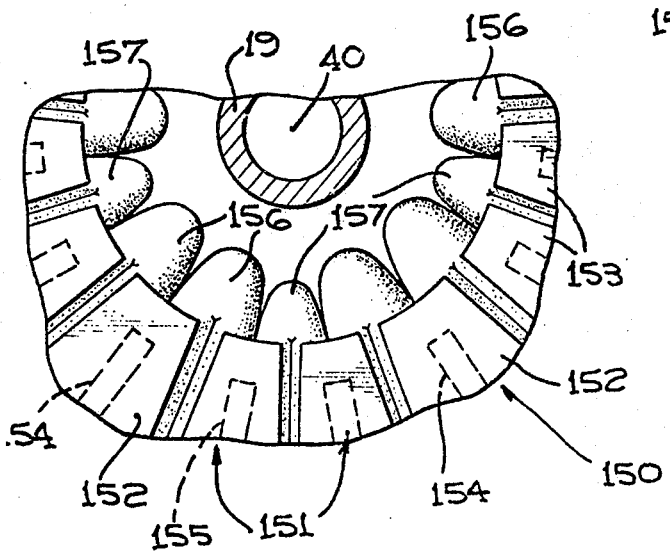
Figure 22:
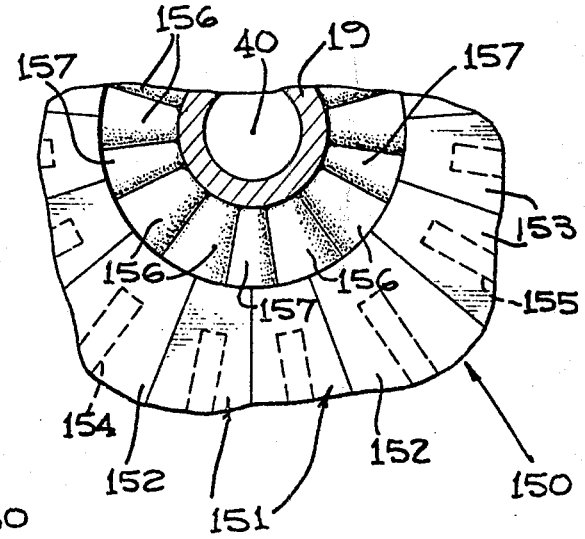
Figure 23:
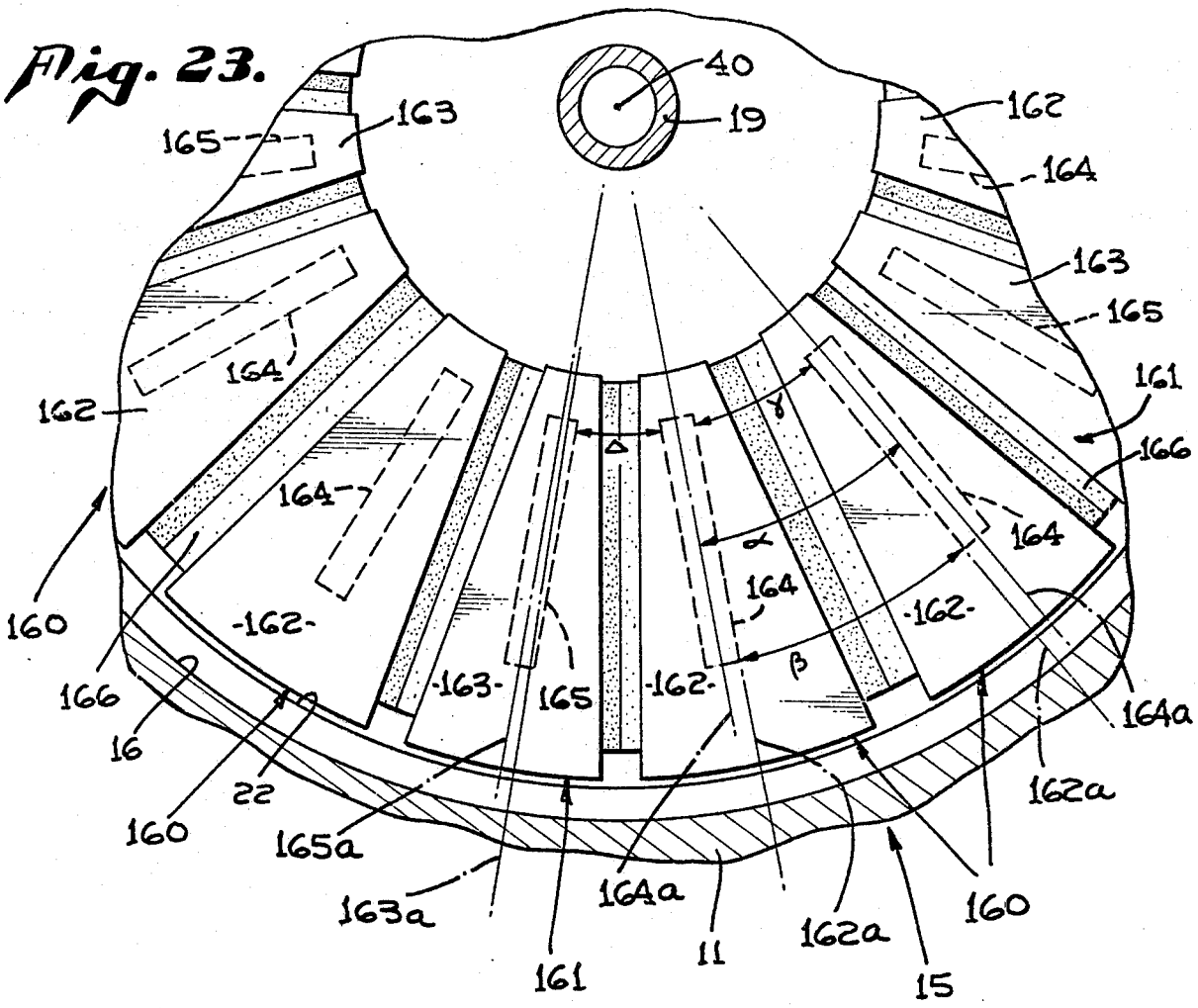
Figure 24:
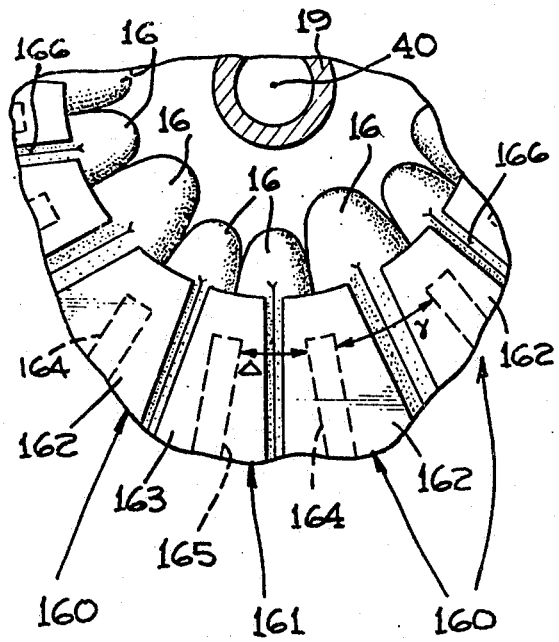
Figure 25:
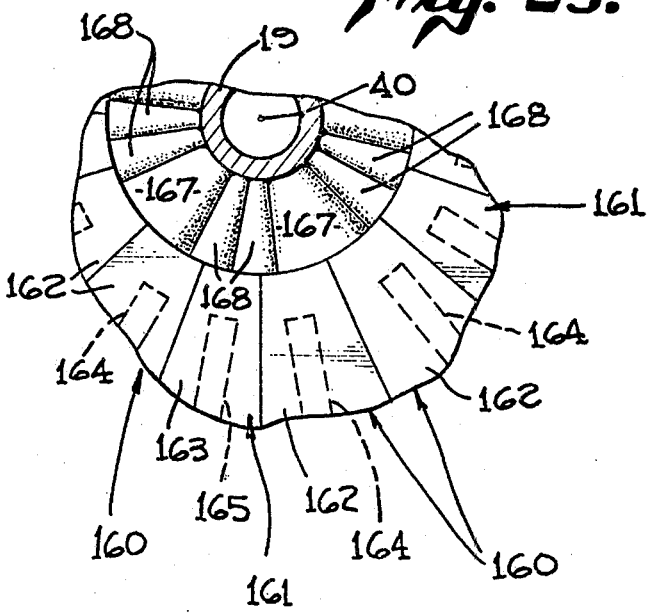
Figure 26:
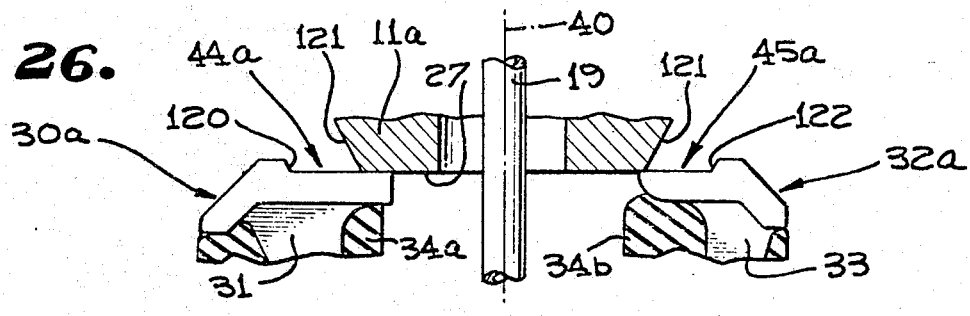
Figure 27:
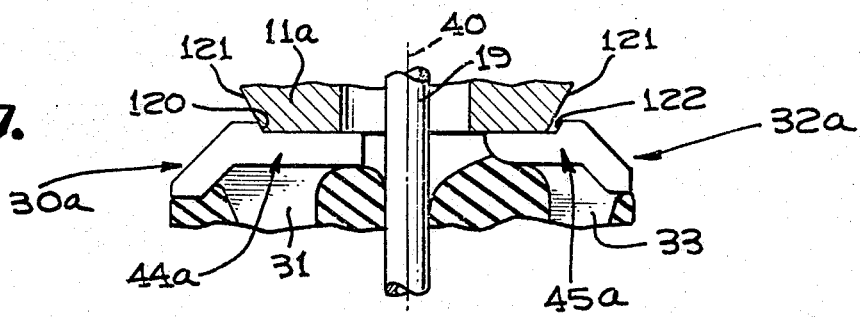
Figure 28:
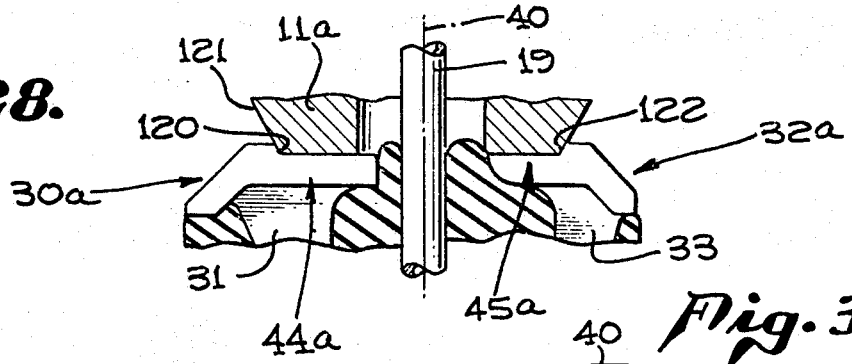
Figure 29:
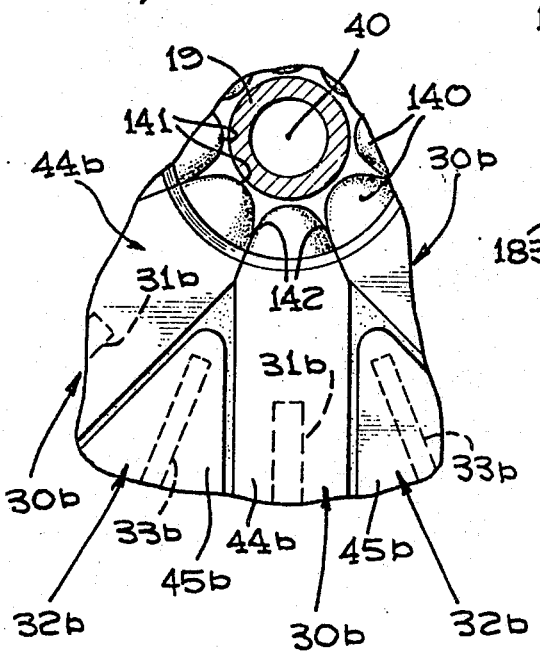
Figure 30:
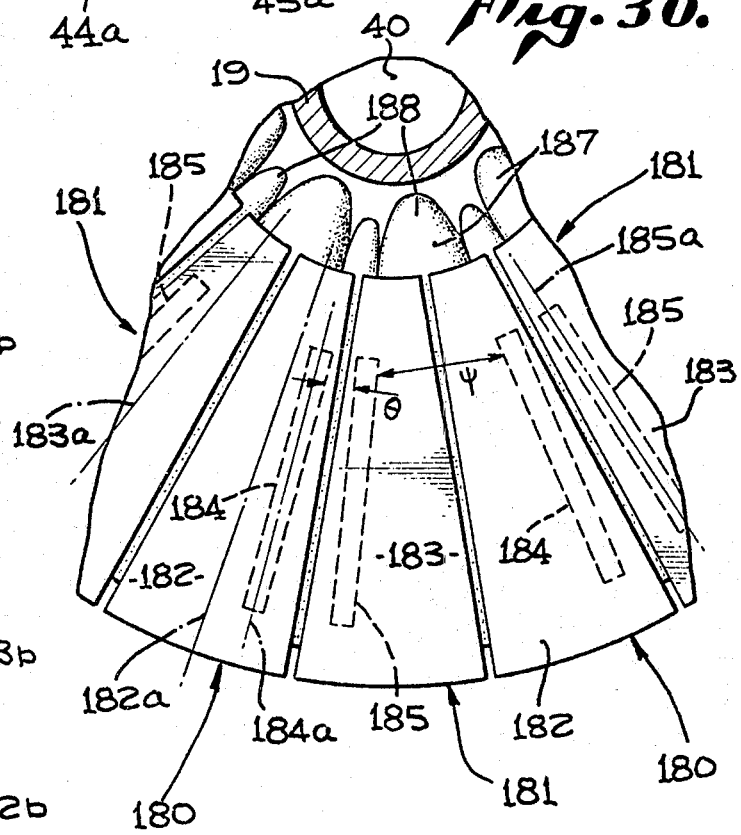
Figure 2:
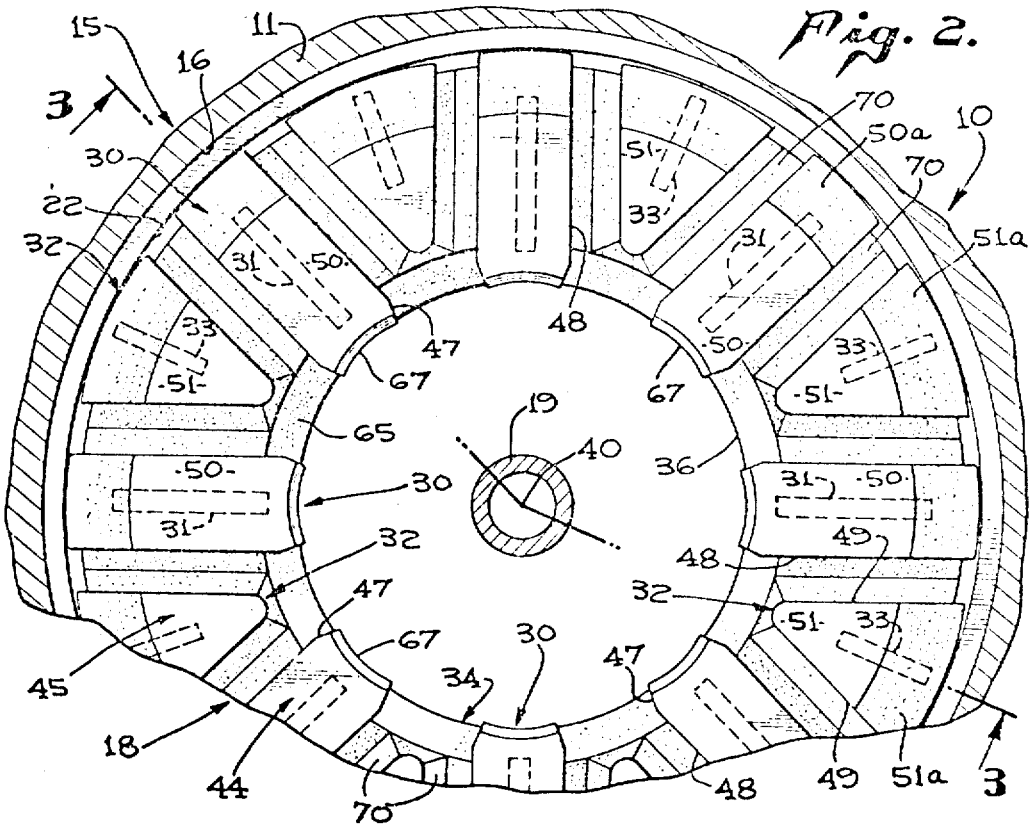
Figure 3:
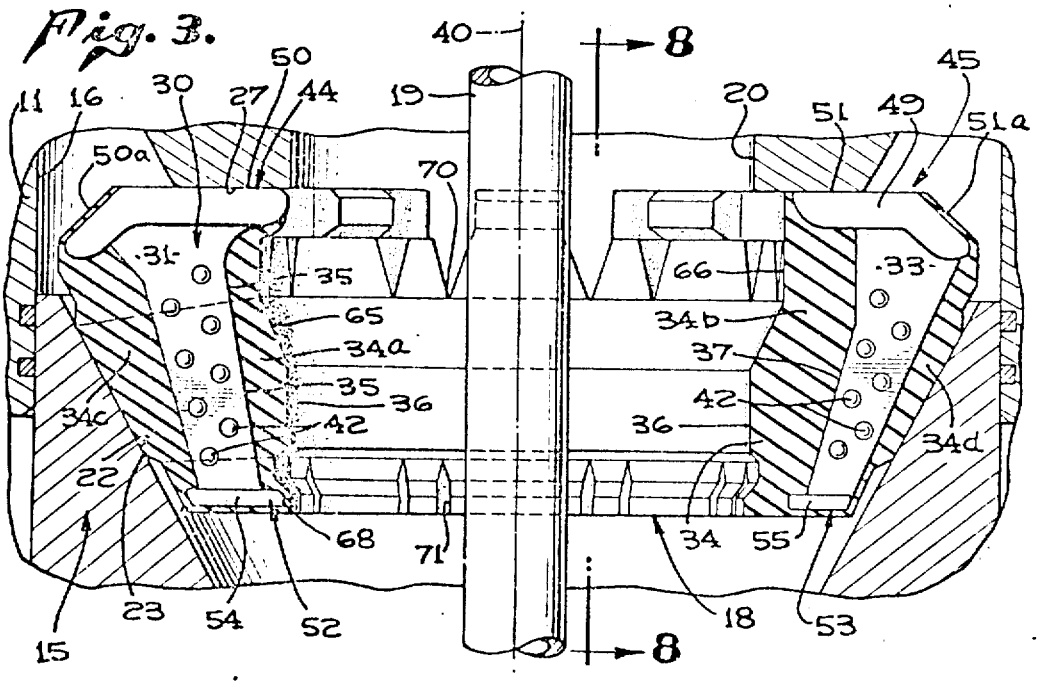
Figure 4:
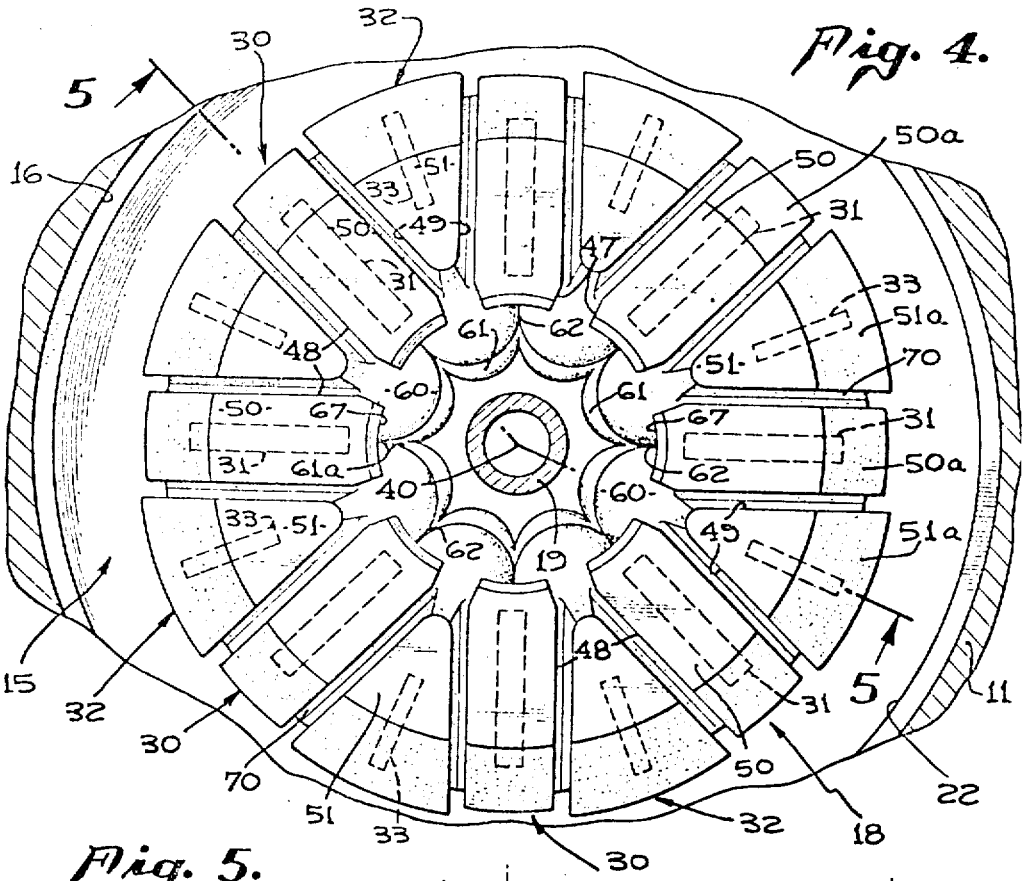
Figure 5:
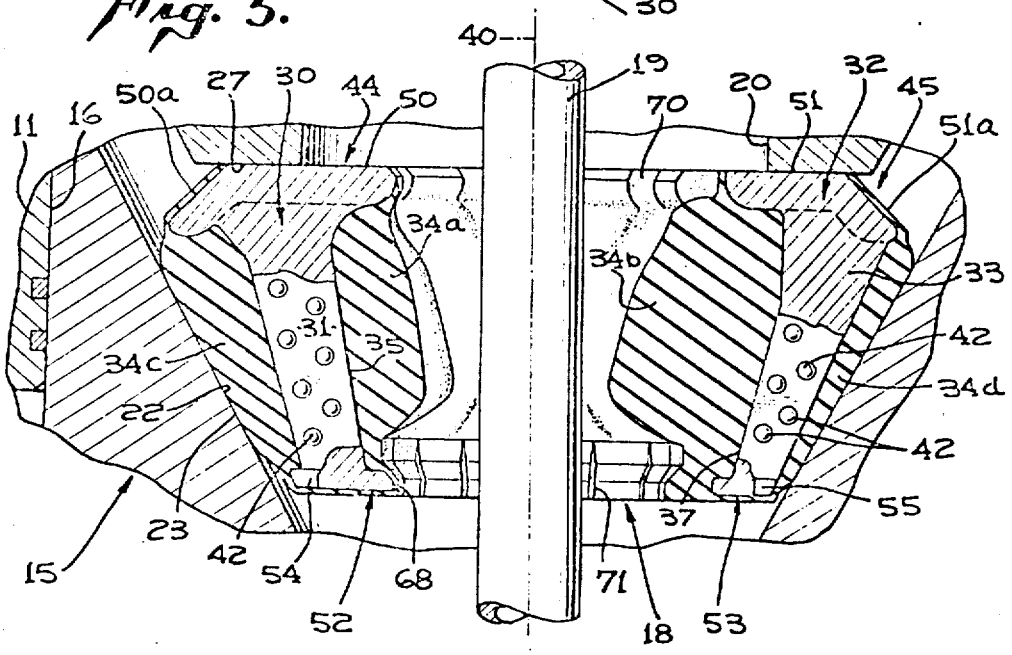
Figure 6:
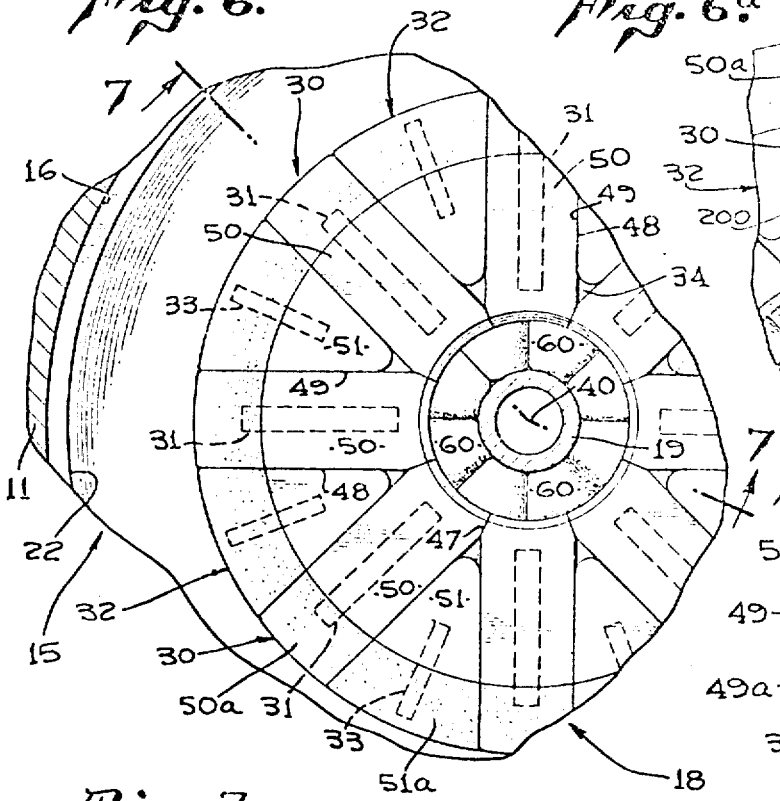
Figure 6A:
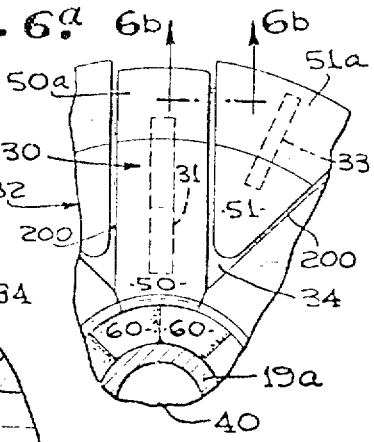
Figure 6B:
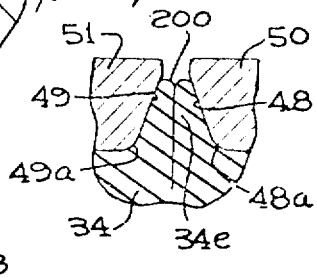
Figure 7:
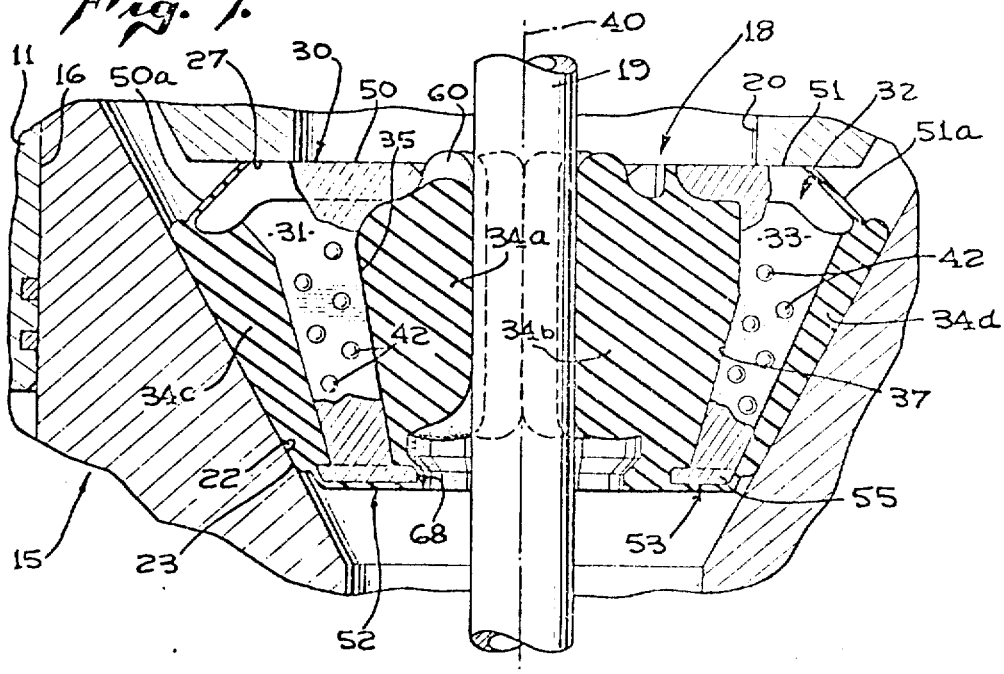
Figure 10:
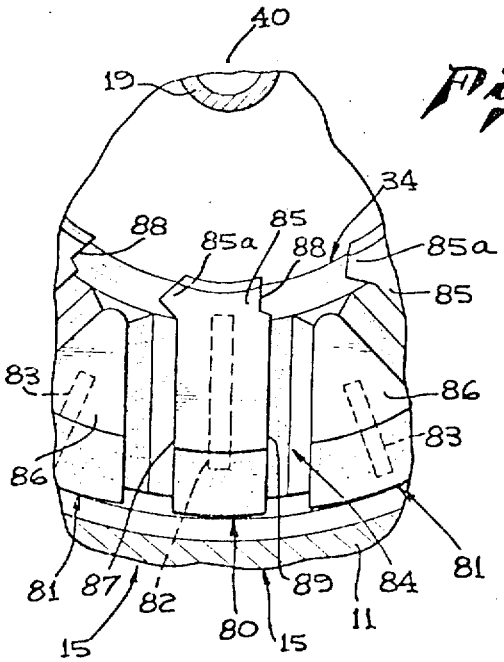
Figure 13:
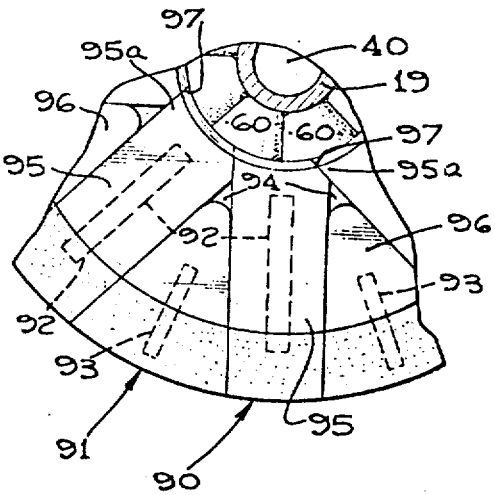
Figure 11:
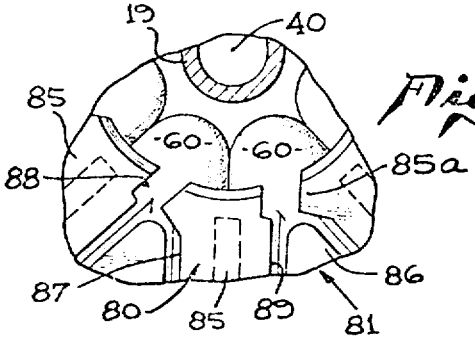
Figure 14:
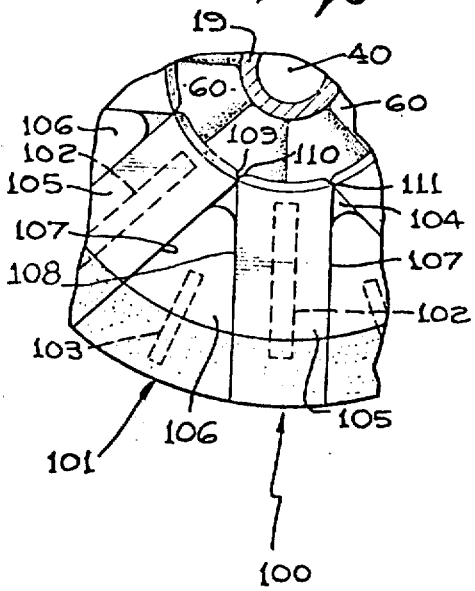
Figure 12:
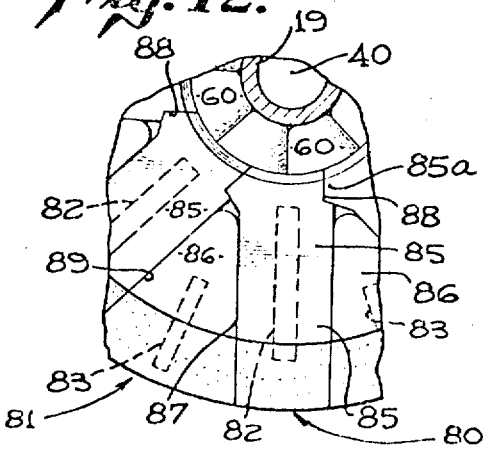
Figure 15:
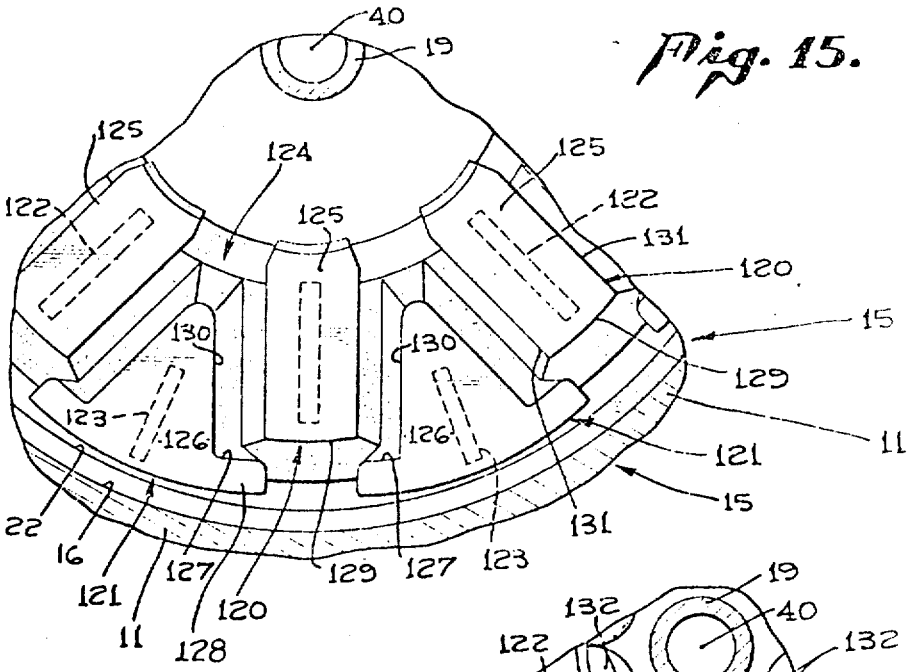
Figure 16:
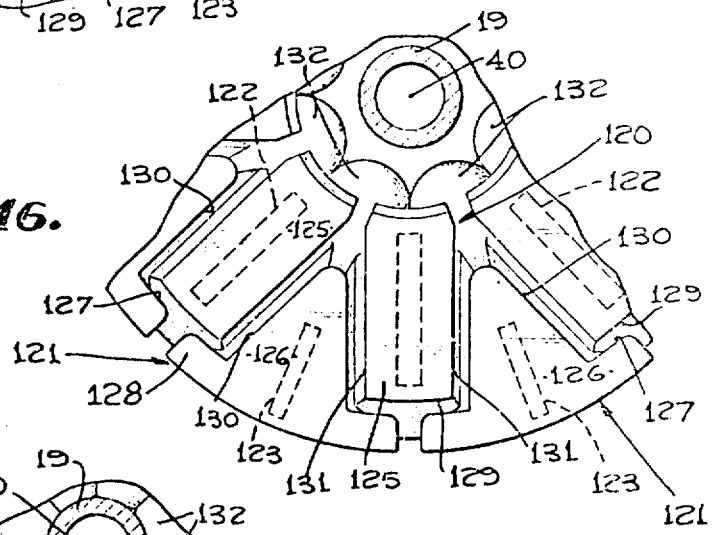
Figure 17:
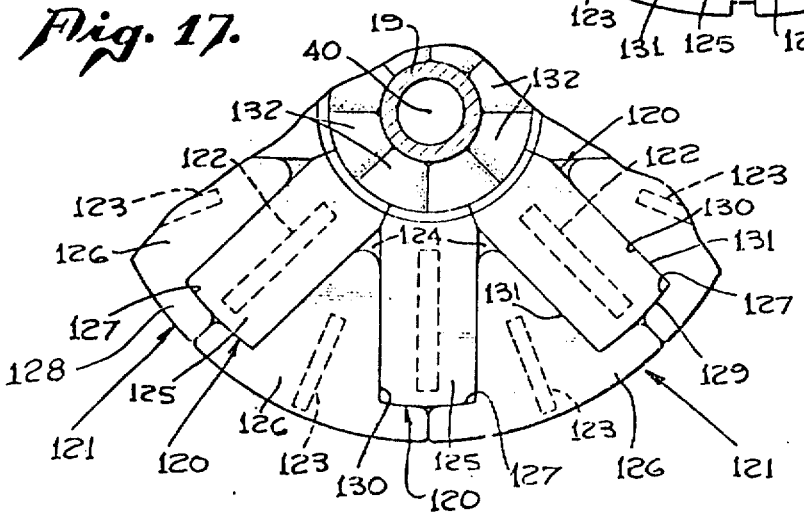
Figure 18:
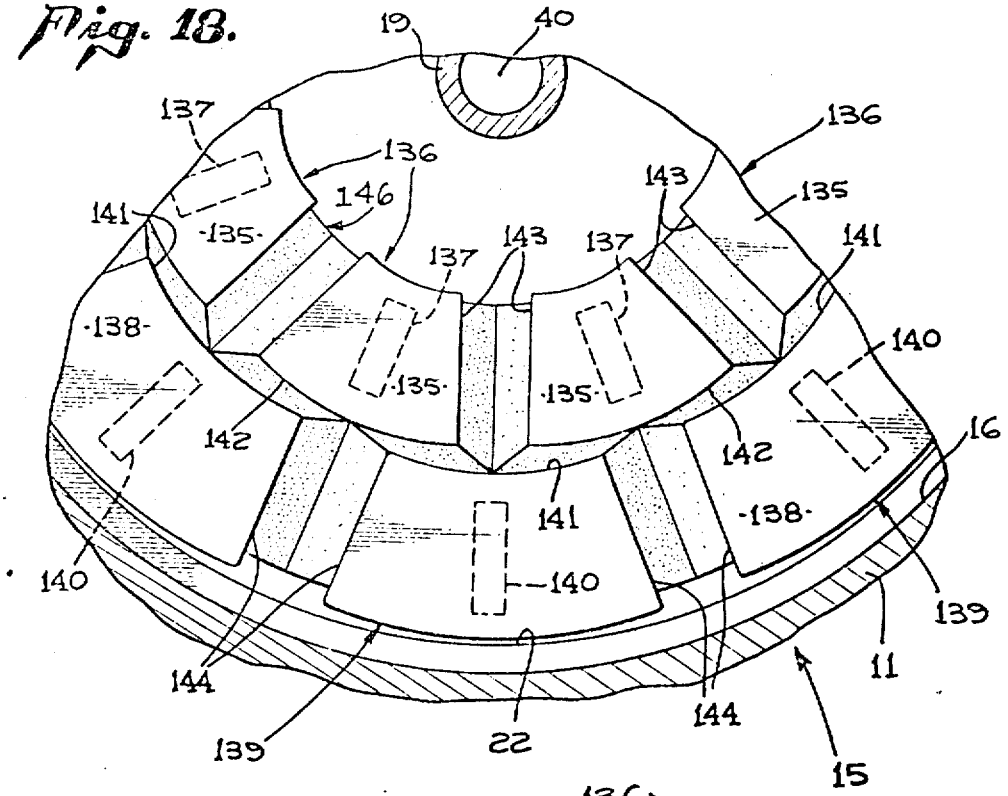
Figure 19:
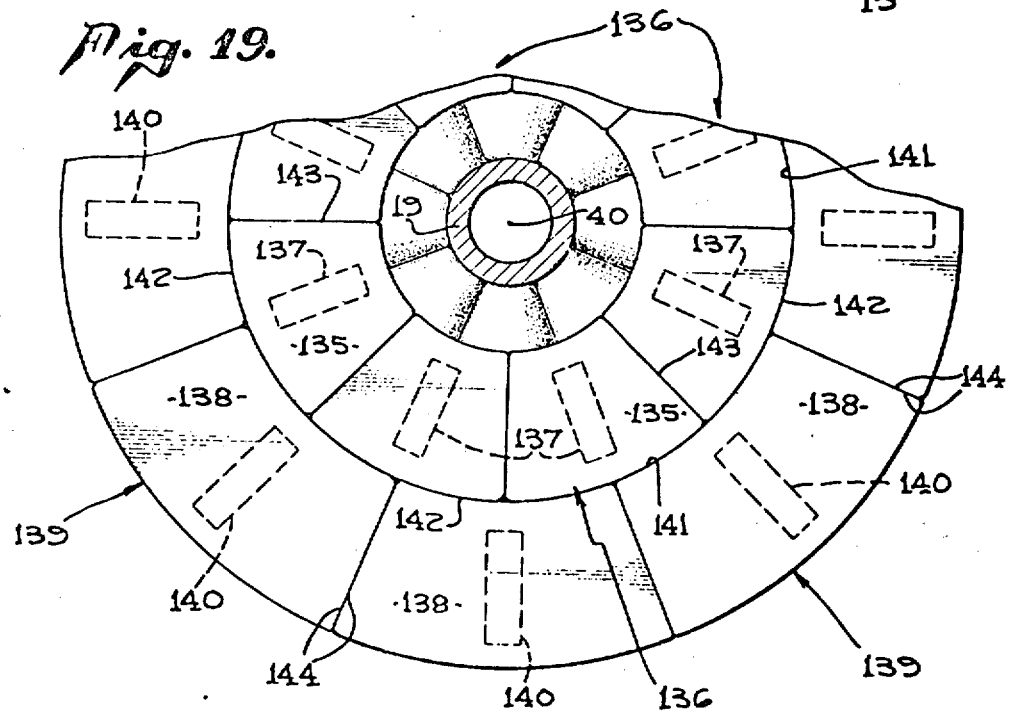
Figure 20:
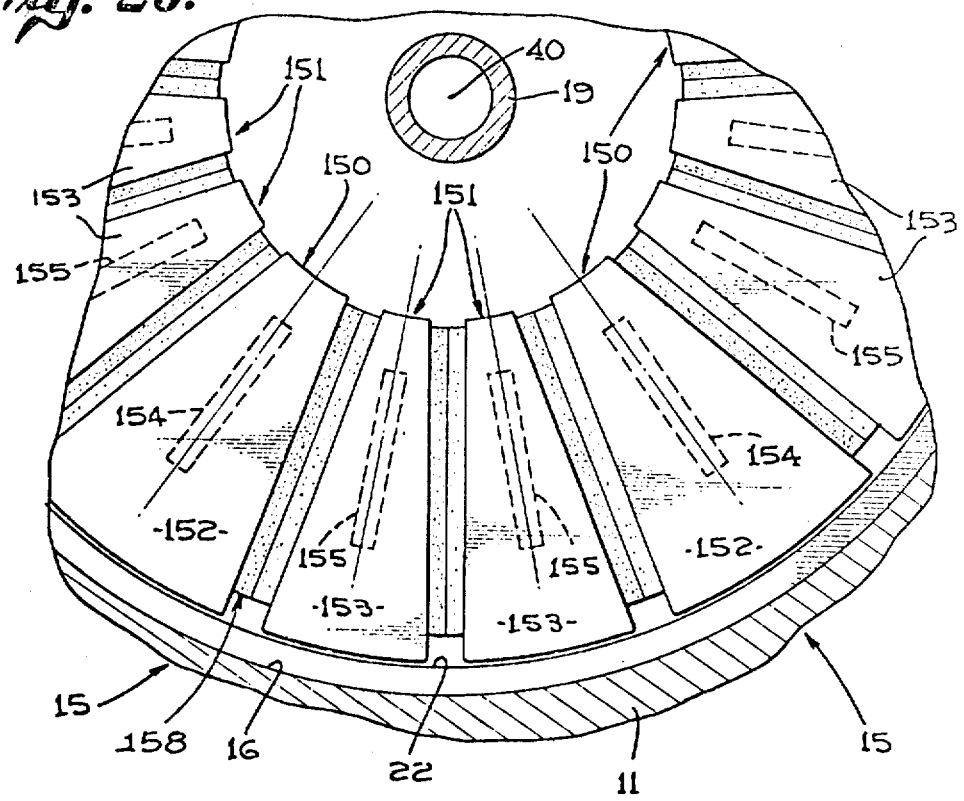
Figure 21:
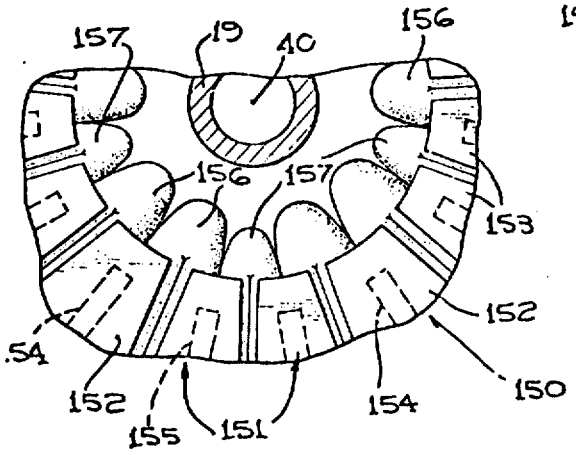
Figure 22:
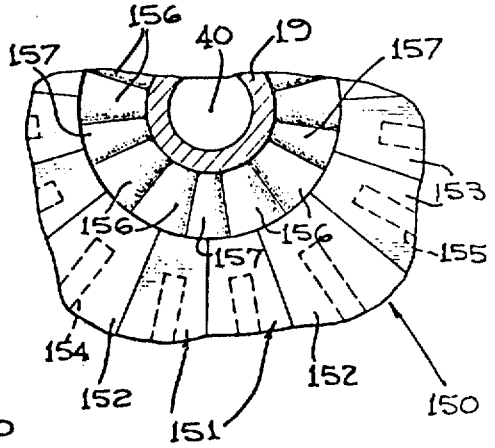
Figure 23:
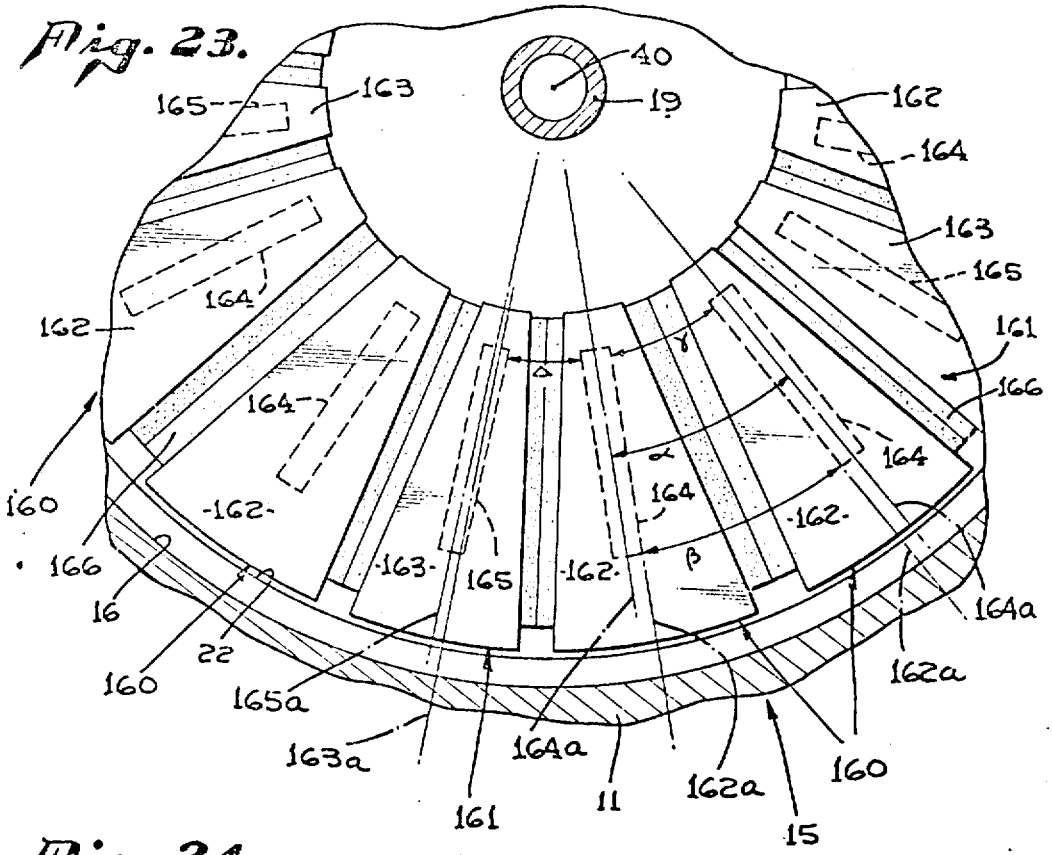
Figure 24:
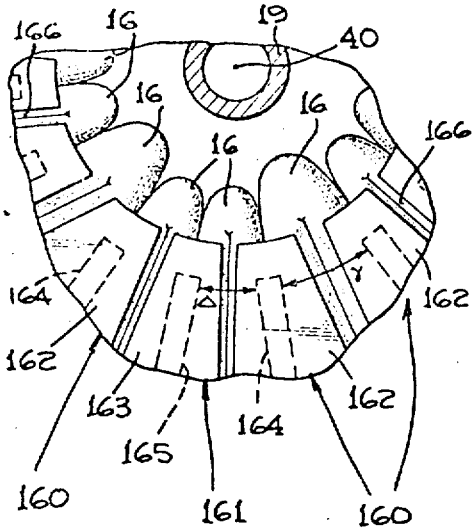
Figure 25:
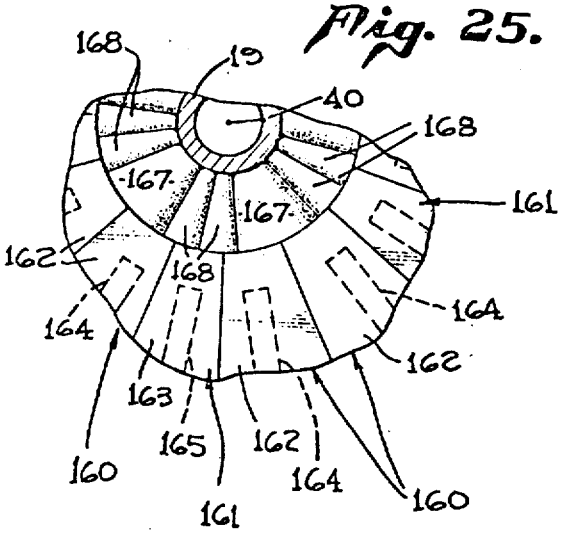
Figure 26:
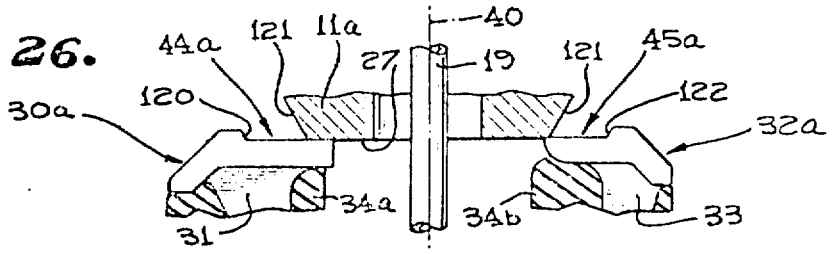
Figure 27:
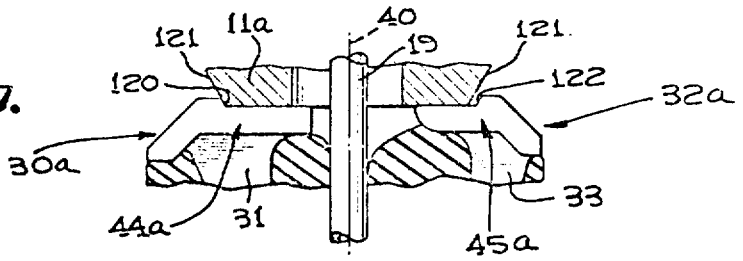
Figure 28:
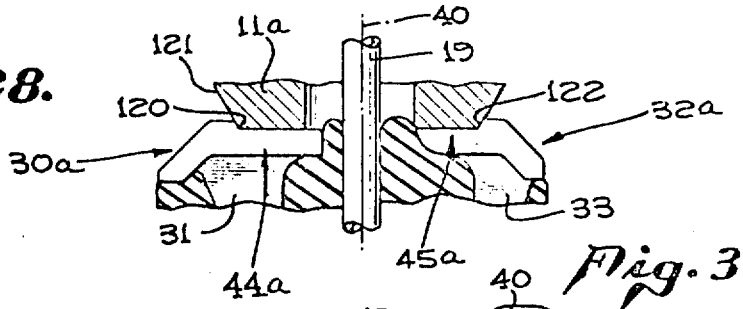
Figure 29:
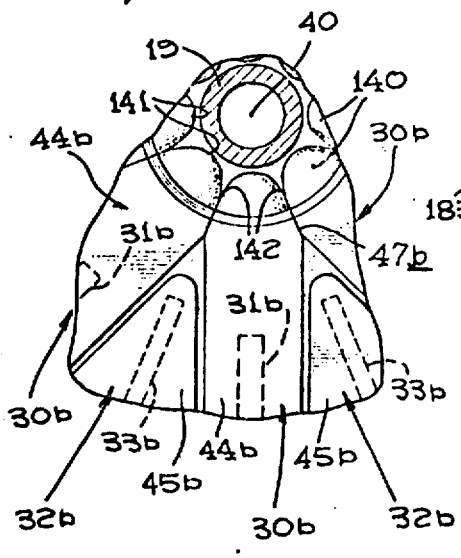
Figure 30:
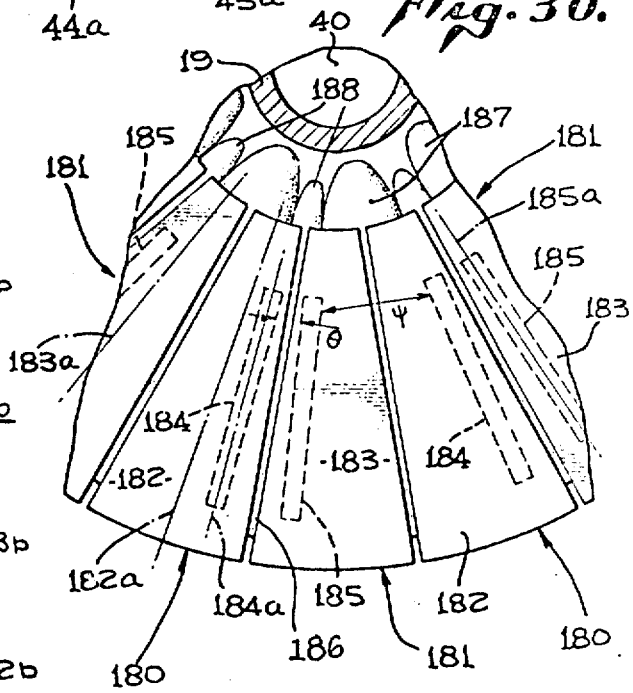

FIG. 7 is a vertical section on lines 7—7 of FIG. 6;

FIG. 8 is a section on lines 8—8 of FIG. 3;

FIG. 9 is a perspective showing of two types of metallic inserts used in the packer of FIGS. 2–8;

FIGS. 10–12 are fragmentary plan view showings of a modified packer in open, partly closed and fully closed conditions, respectively;

FIGS. 13 and 14 are fragmentary plan view showings of two additional modified packers, in closed condition, respectively;

FIGS. 15–17 are fragmentary plan view showings of another modified packer in open, partly closed and fully closed conditions, respectively;

FIGS. 18 and 19 are fragmentary plan view showings of yet another modified packer in open and fully closed positions, respectively;

FIGS. 20–22 are fragmentary plan view showings of a further modified packer in open, partly closed and fully closed conditions, respectively;

FIGS. 23–25 are fragmentary plan view showings of still another modified packer, in open, partly closed and fully closed conditions, respectively;

FIGS. 26–28 are fragmentary vertical sections through a modified packer in open, partly closed and fully closed conditions, respectively; and FIGS. 29 and 30 are plan views of further modified packers.

DETAILED DESCRIPTION

Figure 1:
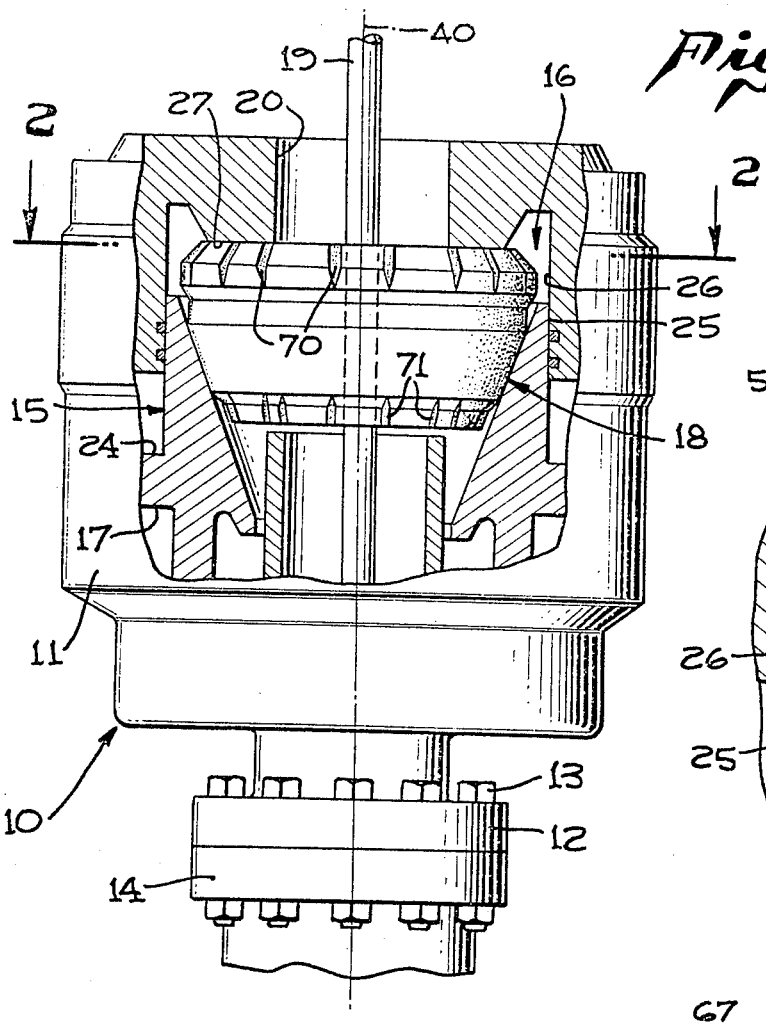
FIG. 1 is an elevation, partly in section, showing use of the new packer.

Referring to FIG. 1, a blowout preventer 10 includes a metallic housing 11, the lower most extent of which is flanged at 12 and bolted at 13 to well head casing flange 14 or other well head equipment. The housing contains a piston 15 movable upwardly in chamber 16 in response to fluid pressure exertion upwardly against piston face 17, for constricting an annular packer unit 18 via pressure exertion from piston cam surface 22 against packer exterior surface 23. Surfaces 22 and 23 are frusto-conical and flared upwardly. The packer when sufficiently radially inwardly displaced, seals off about a well pipe 19 shown extending axially vertically through the preventer 10; and in the absence of the pipe, the packer unit 18 will completely close off the vertical passage 20 through the preventer, when the unit is sufficiently constricted by piston 15. Upon downward movement of the piston in response to fluid pressure exertion against face 24, the packer expands radially outwardly to the open position seen in FIGS. 1 and 2. Note that the piston annular surface 25 may have guided sliding engagement with housing cap bore 26, and that the packer unit is normally confined vertically under the housing cap lower interior surface 27.

In accordance with the invention, the packer unit comprises metallic inserts generally circularly spaced about the longitudinal central axis of the unit, the inserts including webs that extend generally longitudinally; an annulus of elastomeric material extending about the packer axis and embedding the webs so that they anchor the material during inward compressive displacement or constriction of the packer; and the spacing of the webs from that axis and from each other is characterized by differential anchoring about the axis of circularly spaced portions of the elastomeric material subject to inward displacement about the axis. Such differential anchoring facilitates differential inward flow or extrusion of circularly spaced portions of the elastomeric material, as will be seen, to the end that maximum stretching of the material is minimized and maximum stresses are correspondingly minimized. Such material is designated at 34.

PACKER UNIT I

In the first example seen in FIGS. 1–9, the metallic inserts include certain inserts 30 having certain webs 31, and other inserts 32 having other webs 33, and the anchoring of the elastomeric material 34*a* by certain webs 31 is closer to the central axis 40 then the anchoring of the material 34*b* by the other webs 33 as is clear from FIG. 3. For example, the thickness of the material 34*a* between the inner edge portions 35 of webs 31 and the packer bore 36 is less than the thickness of the material 34*b* between the inner edge portions 37 of webs 33 and the packer bore 36, in planes normal to axis 40; also, inner edge portions 35 of webs 31 are located closer to axis 40 than inner edge portions 37 of webs 33, in planes normal to axis 40, and webs 31 alternate with webs 33 about axis 40, as is clear from FIG. 2. The webs may additionally carry buttons 42 to provide additional surface to which the elastomeric material may be attached, for additional anchoring effect. Such material may for example consist of synthetic or natural rubber.

The inserts also have plates integral with the webs, and circularly spaced about axis 40, certain plates on certain inserts located to move closer to axis 40 than other plates on other inserts during radially inward compressive displacement of the packer. For example, the top plates 44 on "certain" inserts 30 are located to move closer to axis 40 than the top plates 45 on "other" alternate inserts 32, as is clear from examination of the sequential closing views, FIGS. 2 and 3 (OPEN), FIGS. 4 and 5 (PARTLY CLOSED) and FIGS. 6 and 7 (FULLY CLOSED).

It will be noted, referring to FIG. 9, that plates 44 and 45 alternate around the axis 40; that the plates each have circularly spaced opposite sides, and that radially inward opposite side extents 47 of plates 44 are formed to interfit in FIG. 6 closed condition of the packer, limiting further closure of the inserts. Thus, opposite side extents 47 may lie in radial axial planes whereas the major opposite side extents 48 of the plates 44 are generally parallel and extend generally inwardly toward pipe 19. Further, the circularly spaced opposite sides 49 of wedge shaped plates 45 taper directionally inwardly so as to engage opposite sides 48 of plates 44 as seen in FIG. 6. Accordingly, sides 49 are parallel to sides 48 with which they are engageable. The tops 50 and 51 of the plates 44 and 45 project above the top level of the elastomeric body material 34, so as to be slidably engageable with the housing surface 27 as referred to above, and the outer extents 50*a* and 51*a* of such tops are beveled downwardly and outwardly, as shown in FIG. 9.

Figure 2:
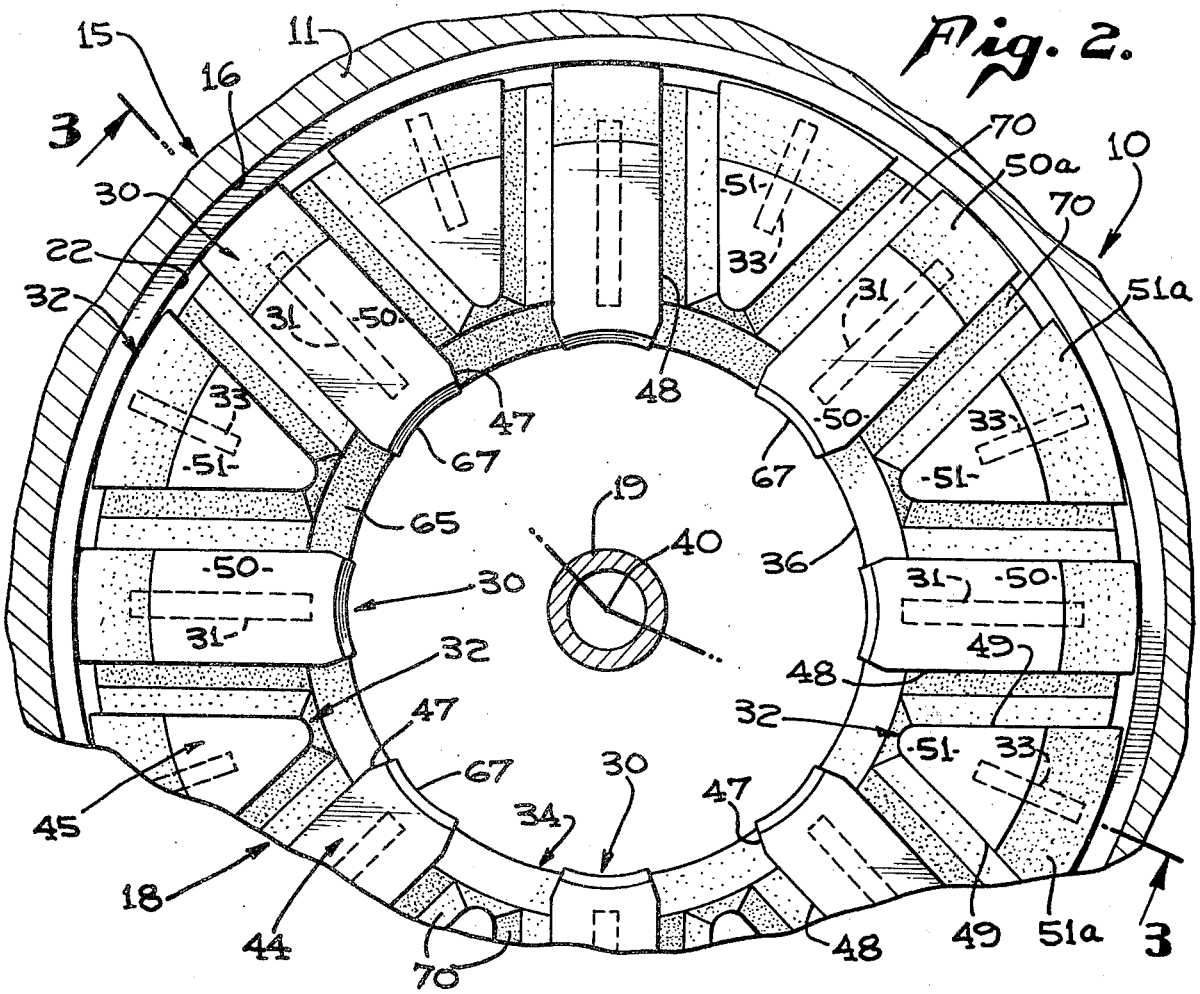
FIG. 2 is an enlarged horizontal section, taken on lines 2—2 of FIG. 1, and showing the packer in open condition.
Figure 4:
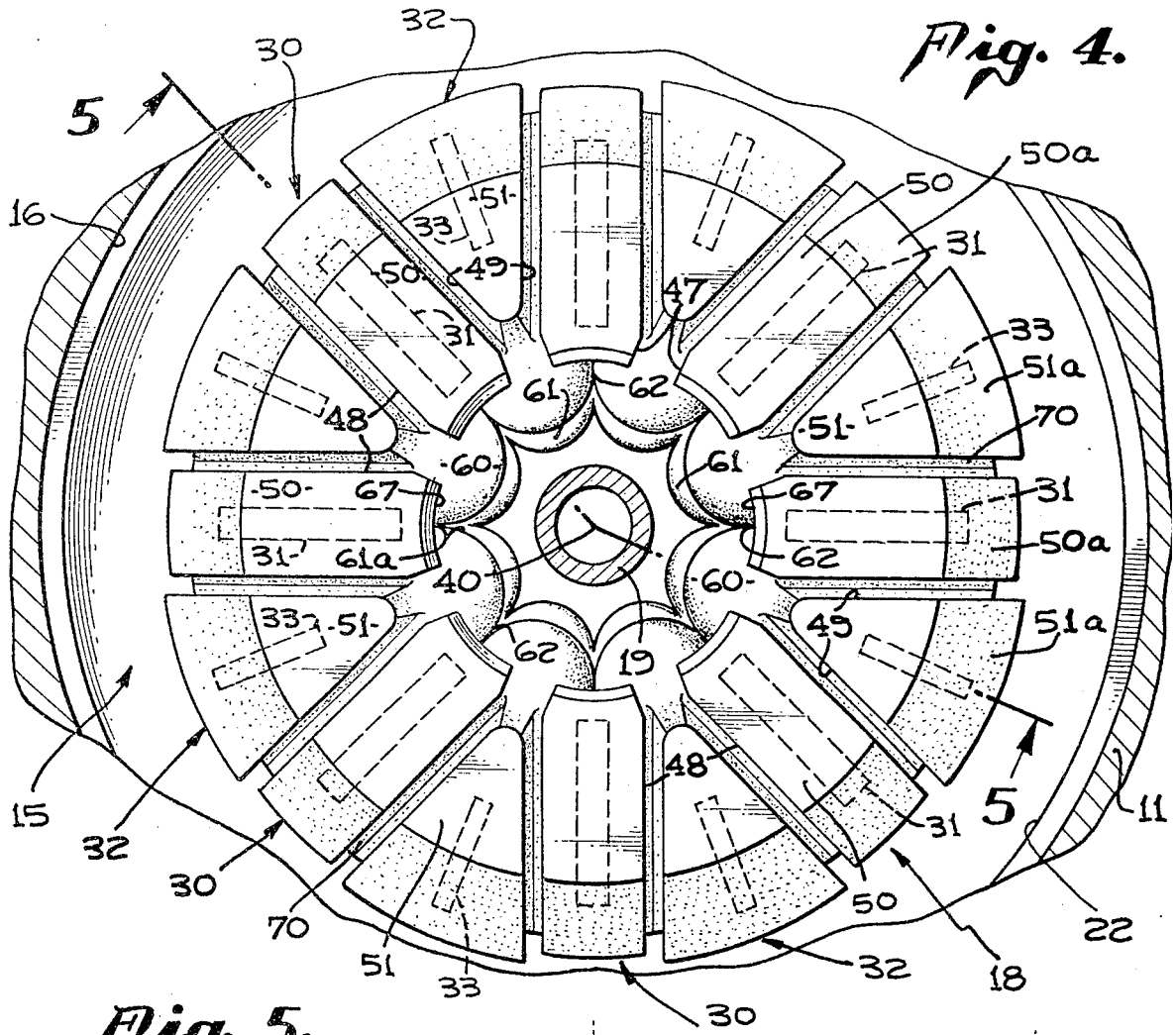
FIG. 4 is a view like FIG. 2, and showing the packer in partly closed condition.
Figure 5:
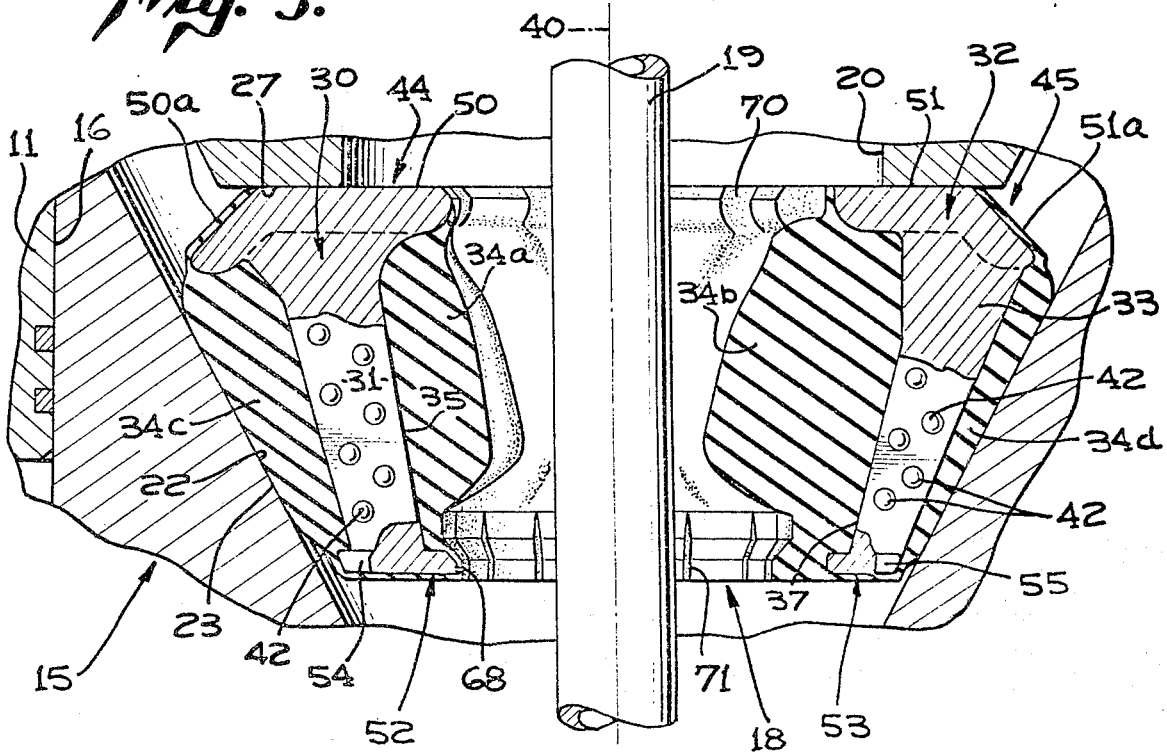
FIG. 5 is a vertical section on lines 5—5 of FIG. 4.

In similar manner, the bottom plates 52 on inserts 30 are located to move closer to axis 40 than the bottom plates 53 on the other alternate inserts 32, as is clear from FIGS. 2 and 3 (OPEN), FIGS. 4 and 5 (PARTLY CLOSED) and FIGS. 6 and 7 (FULLY CLOSED). Plates 52 and 53, integral with the webs 31 and 33 respectively, alternate about axis 40; plates 52 have generally parallel opposite sides 54 the extend generally inwardly and parallel to sides 48 of plates 44; and plates 53 have opposite sides 55 that taper inwardly toward the center region of the packer, to engage sides 54 when the packer is closed as in FIG. 6.

FIGS. 3, 5 and 7 also illustrate the condition that the radial thickness of the elastomeric material 34*c* radially outwardly of certain webs 31 is greater than the radial thickness of the elastomeric material 34*d* radially outwardly of other webs 33, in planes normal to axis 40. Plates 52 and 53 seat on the upper end 28 of tube 29, when the packer unit is not constricted inwardly by piston 15.

FIGS. 4–7 illustrate the manner in which elastomeric material flows inwardly in protruding folds or waves 60, one for each pair of inserts as the packer is constricted inwardly. Each fold forms to have an inwardly convex surface 61 which advances toward pipe 19, the opposite outer edges 61*a* of adjacent surfaces 61 merging as cusps 62 located directly radially inwardly of webs 31; and the innermost edge of each fold lies directly inwardly of a web 33. FIGS. 6 and 7 show the folds in compressive sealing engagement with the pipe, and each other.

Further, the circular spacing between successive webs is "opened up," by virtue of their successive inward, outward, inward, outward — etc., configurations about axis 40, whereby flow of maximum elastomeric material between the webs is facilitated so that significantly less overall strain of the material is required in order to effect sealing closure about the pipe, than was required in the packer design of U.S. Pat. No. 2,609,836.

To complete the description of the packer, the bore in FIG. 3 includes annular frusto-conical surface 65 flaring upwardly from ring-shaped surface 36; and ring shaped surface 66 directly above surface 65. Also, the innermost edge 67 of each top plate 44 extends as a circular segment about axis 40, and likewise, the innermost edge 68 of each bottom plate 52 extends as a circular segment about axis 40, so that upon completion of packer closure, the merged segments 67 form a circle, and the merged segments 68 form a circle, for stability and strength. Upon interengagement of top plates 44 and/or of bottom plates 52, continued upward travel of piston 15 against the elastomeric packer periphery assures inward displacement of the inserts 32 relative to inserts 30, as required, to advance the wedge shaped top plates 45 toward edge to edge engagement with plates 44, and wedge shaped bottom plates 53 toward edge-to-edge engagement with plates 52, providing a stable, interlocked insert structure to anchor the elastomeric material against pull-away under the tremendous well fluid pressures exerted on the packer.

Finally, it should be noted that the top and bottom plates protrude from the body 34 of elastomeric material, and that radial grooves 70 and 71 are typically sunk into the material beneath the spaces between successive plates in each row, as is clear from FIGS. 1 and 2.

FIG. 6*a* shows PACKER UNIT I in another mode of closure, wherein pipe 19*a* is a larger diameter than pipe 19. In this case, the opposite sides 49 of plates 51 do not come into engagement with the opposite sides 48 of plates 50; rather, plates 51 approach toward interfitting engagement with plates 50, and elastomeric or rubber material 34 may extrude into the spaces 200 between the sides 48 and 49 of the plates if constricting pressure is sufficiently great. Note in FIG. 6*b* that the plate sides 48 and 49 may taper away from the mass of body 34, so that elastomeric material 34*e* flowing or extruding into space 200 tapers away from that mass, to minimize stretch and flow in that space. Also, plate corners 48*a* and 49*a* may be rounded to prevent tearing during such flow, into and out of space 200 as the packer is constricted and later released, to expand. Space 200 is radially elongated. Also, rubber 34*e* tends to be forced back toward the main body 34 as plate edges 48 and 49 move relatively together during constriction, so that the rubber does not become entrapped between such edges to resist relative closure. This in turn facilitates full forward motion of the inserts to support the rubber that seals against the pipe 19. Bottom plates may be similarly formed.

PACKER UNIT II

Referring now to FIGS. 10–12, the inserts 80 and 81 correspond generally to inserts 30 and 32, respectively, with webs 82 and 83 embedded in elastomeric annular body 84. Top plates 85 and 86 correspond to top plates 50 and 51, respectively. In fact 86 and 51 may be identical. In addition, the radially inward opposite side extents of the plates 85 have dovetail interfit, as for example is illustrated in FIG. 12 by interfit of the tongue 85*a* (protruding from plate side 87) into the recess 88 (formed in side 89). Thus, plates 85 become interlocked in mutually supported relation. Bottom plates, not shown, may have configurations like the top plates.

PACKER UNIT III

In FIG. 13, the inserts 90 and 91 correspond generally to inserts 30 and 32, respectively, with webs 92 and 93 embedded in elastomeric annular body 94. Top plates 95 and 96 correspond to top plates 50 and 51, respectively. In addition, the radially inward opposite side extents of the plates 95 have overlapping relation in one direction about packer axis 40, when the packer inserts are radially inwardly displaced to maximum extent, thus, for example, the inward side extents 95*a* of the plates 95 overlap the beveled opposite side extents 97 of adjacent plates 95, locking those plates in mutually supported relation. Bottom plates, not shown, may have configurations like the top plates.

PACKER UNIT IV

In FIG. 14, the inserts 100 and 101 correspond generally to inserts 30 and 32, respectively, with webs 102 and 103 embedded in elastomeric body 104. Top plates 105 and 106 correspond to top plates 50 and 51, respectively. In addition, the radially inwardly directed opposite sides 107 and 108 of the plates 105 are substantially parallel throughout the major length of said sides; i.e., only the innermost edges 109 and 110 of those sides are rounded, inwardly of interengaged plate corners at 111. Bottom plates, not shown, may have configuration like those of the top plates.

PACKER UNIT V

In FIGS. 15–17, the inserts 120 and 121 correspond generally to inserts 30 and 32, respectively, with webs 122 and 123 embedded in elastomeric body 124. Top plates 125 and 126 correspond respectively to top plates 50 and 51. Further, plates 121 have inwardly facing shoulders 127 on wings 128 which closely circumferentially overlap radially outwardly facing shoulders or extents 129 of plates 125, in response to compressive displacement of the packer, as seen in FIG. 17. This condition occurs simultaneously with interengagement of opposite side shoulders 130 on plates 126 with opposite side shoulder 131 on plates 125. Note the sealing engagement of the elastomeric folds 132 of the packer body with the pipe, in FIG. 17. Bottom plates, not shown, may have configurations like those of the top plates.

PACKER UNIT VI

In FIGS. 18 and 19, certain top plates 135 formed by certain inserts 136 (with webs 137) are circularly spaced in one ring-shaped path about axis 40 and pipe 19; and other top plates 138 formed by other inserts 139 (with webs 140) are circularly spaced in another ring shaped path about axis 40 and pipe 19. Such paths are concentric, with the plates 138 lying generally radially outwardly of plates 135; further, each plate 138 overlaps or bridges portions of two plates 135, as is clear from the drawings. In fully closed condition of the packer, as seen in FIG. 19, the inner concave sides 141 of plates 138 engage and fit the convex outer sides 142 of plates 135; and the radially straight opposite sides 143 of plates 135 are interengaged; and the radially straight opposite sides 144 of plates 138 are interengaged. The packer elastomeric annular body 146 embeds webs 137 and 140 as shown, and is downwardly grooved between the plates. Bottom plates, not shown, may have configurations like those of the top plates.

PACKER UNIT VII

In FIGS. 20–22, the inserts 150 and 151 have respective wedge shaped top plates 152 and 153 integral with webs 154 and 155. The webs are circularly spaced about axis 40, with the spacing between certain webs (154 and 155, for example) being greater than the circular spacing between other webs (155 for example), in common circles about that axis. Note that plates 152 are circumferentially larger than plates 153, and that two of the latter are located between successive larger plates 152. As a result, more elastomeric material of body 158 flows radially inwardly in the space between webs 154 and 155 (to produce larger folds 156) than flows between webs 155 (to produce smaller folds 157), and less net strain of the total material ensues than if the webs were all equally spaced apart, circumferentially. Bottom plates integral with the webs may have configurations like the top plates.

PACKER UNIT VIII

In FIGS. 23–25, the inserts 160 and 161 also have respective wedge shaped top plates 162 and 163 integral with webs 164 and 165. The webs are circularly spaced about axis 40, with the circular spacing between certain webs (164 for example) larger than the circular spacings between other webs (webs 164 and 165, for example), in common circles about that axis. Note that plates 162 are circumferentially larger than plates 163, for example, and that two of the larger plates 162 are located between successive smaller plates. Also, in the inserts 160, the webs extend in or define axial radial planes (as at 164*a*) which the circumferentially offset from axial radial planes (as at 162*a*) which bisect the plates and in such relationship that the angle $\alpha$ between planes 164*a* exceeds the angle $\beta$ between planes 162*a*. As a result, more elastomeric material of body 166 flows radially inwardly in the larger angular gap between the webs 164 (to produce larger folds 167) than flows inwardly in the smaller angular gap $\Delta$ between webs 164 and 165 (produce smaller folds 168), and less net strain of the total material ensues than if the webs were all equally spaced apart circumferentially. Bottom plates integral with the webs may have configurations like the top plates.

PACKER UNIT IX

In FIGS. 26–28, modified inserts 30*a* and 32*a* are like inserts 30 and 32, respectively; however, plates 44*a* (corresponding to plates 44) carry stop shoulders 120 adapted to engage annular shoulder structure 121 on the housing cap 11*a;* and, plates 45*a* (corresponding to plates 45) carry stop shoulders 122 also adapted to engage annular shoulder structure 121. None of the stop shoulders 120 and 122 engage fixed shoulder structure 121 when the packer is open as seen in FIG. 26; however, when the packer is partly closed, as in FIG. 27, shoulders 120 on plates 44*a* engage shoulder structure 121 limiting further inward displacement of inserts 30*a*, while shoulders 122 are not yet engaged against shoulder structure 121. This condition may for example correspond to FIG. 6*a*, as described above. Subsequently, as the packer is further constricted, inserts 32*a* move inwardly until shoulders 122 engage shoulder structure 121, as seen in FIG. 28, after which the packer rubber external to the inserts 32*a* may be even further inwardly displaced to cause seal off against the pipe 19 with greater pressure, the webs 31 and 33 acting as fixed anchors for such rubber.

PACKER UNIT X

In FIG. 29, inserts 30*b* and 32*b* correspond to inserts 30 and 32, respectively, excepting that inner edge portions of webs 31*b* associated with inserts 30*b* are located further from axis 40 than the inner edge portions of webs 33*b* associated with inserts 32*b*. This is opposite from the construction of FIG. 2 and FIG. 3. As a result, the folds 140 of rubber being extruded inwardly toward the pipe 19 have convex forward edges 141 with cusps 142 proximate the interengaged edges 47*b* of plates 44*b;* further, while this will produce folds of extruded rubber similar to those of FIG. 4 and 5, the location of the cusps of FIG. 4 straddle the junctions 47 of plates 50 while the cusps of FIG. 29 are at the junction 47*b* of plates 44*b*. When the cusps are in this position a wider base of rubber is presented to receive the pull of the rubber forming the folds, and any discontinuity at junction 47*b* will be located at a point of least stress in the rubber. This construction serves to lower the strain in the rubber with concomitant lower level of stress in the rubber being resiliently extruded.

PACKER UNIT XI

In FIG. 30, the inserts 180 and 181 have respective wedge-shaped top plates 182 and 183 integral with webs 184 and 185. Note that all plates 182 and 183 are alike in size dimension. Also, the webs are circularly spaced about axis 40, with the circular spacing $\psi$ between certain webs (184 and 185 in clockwise sequence) being larger than the circular spacing $\theta$ between other webs (185 and 184 in clockwise sequence), in common circles about that axis. In inserts 181, the webs extend in or define axial radial planes (as at 185*a*) which are circumferentially offset clockwise from axial radial planes 183*a* which bisect plates 183; and, in inserts 180, the webs extend in or define axial planes (as at 184*a*) which are circumferentially offset counterclockwise from axial radial planes 182*a* which bisect plates 182. As a result, more elastomeric material of body 186 flows radially inwardly in the larger angular gap $\psi$ (to produce larger folds 187) than flows inwardly in the smaller angular gap $\theta$ (to produce folds 188), and less net strain of the total material ensues than if the webs were all equally spaced apart circumferentially. Bottom plates may have configurations like the top plates.

We claim:

1. In the method of sealing off about well pipe, and employing an annular packer unit having metallic inserts generally circularly spaced about the packer axis and an annulus of elastomeric material embedding webs formed by the inserts, the pipe located to project axially through the packer unit, the pipe outer dimension being such that the pipe is engagable by the elastomeric material upon constriction of the packer, the steps that include a. constricting the packer to effect radially inward displacement of the inserts thereby causing interengagement of certain inserts and flow of the material between the inserts and in folds toward the pipe, and b. continuing the packing constriction to urge other inserts inwardly and relatively toward said interengaged inserts, and to further pressurize said folds of material into sealing engagement with the pipe.

2. The method of claim 1 wherein said inserts include plates on the webs, and said constriction is carried out to urge the packer material into spaces formed between the plates, the plates shaped to repel material from said spaces in response to relative closing together of the plates.

3. In the method of sealing off a well opening, and employing an annular packer unit having metallic inserts generally circularly spaced about the packer axis and an annulus of elastomeric material embedding webs formed by the inserts, said axis aligned with said opening, the steps that include:

a. constricting the packer to effect radially inward displacement of the inserts thereby causing interengagement of certain inserts and flow of the material between the inserts and in folds toward said axis, and b. continuing the packer constriction to urge other inserts inwardly and relatively toward said interengaged inserts, and to further pressurize said folds of material into sealing engagement.

4. The method of claim 3 wherein said inserts include plates on the webs, and said constriction is carried out to urge the packer material into spaces formed between the plates, the plates shaped to repel material from said spaces in response to relative closing together of the plates.

5. In the method of sealing off a well tool, and employing an annular packer unit having metallic inserts generally circularly spaced about the packer axis and an annulus of elastomeric material embedding webs formed by the inserts, the tool located to project axially through the packer unit, the tool outer dimension being such that the tool is engageable by the elastomeric material upon constriction of the packer, the steps that include a. constricting the packer to effect radially inward displacement of the inserts thereby causing interengagement of certain inserts and flow of the material between the inserts and in folds toward the tool, and b. continuing the packer constriction to urge other inserts inwardly and relatively toward said interengaged inserts, and to further pressurize said folds of material into sealing engagement with the tool.

6. The method of claim 5 wherein said inserts include plates on the webs, and said constriction is carried out to urge the packer material into spaces formed between the plates, the plates shaped to repel material from said spaces in response to relative closing together of the plates.

* * * * *

UNITED STATES PATENT OFFICE

CERTIFICATE OF CORRECTION

Patent No. 3,958,808 Dated May 25, 1976

Inventor(s) George E. Lewis, et al

It is certified that error appears in the above-identified patent and that said Letters Patent are hereby corrected as shown below:

The drawing figure on the cover sheet should be deleted and substituted with the following drawing figure therefore:

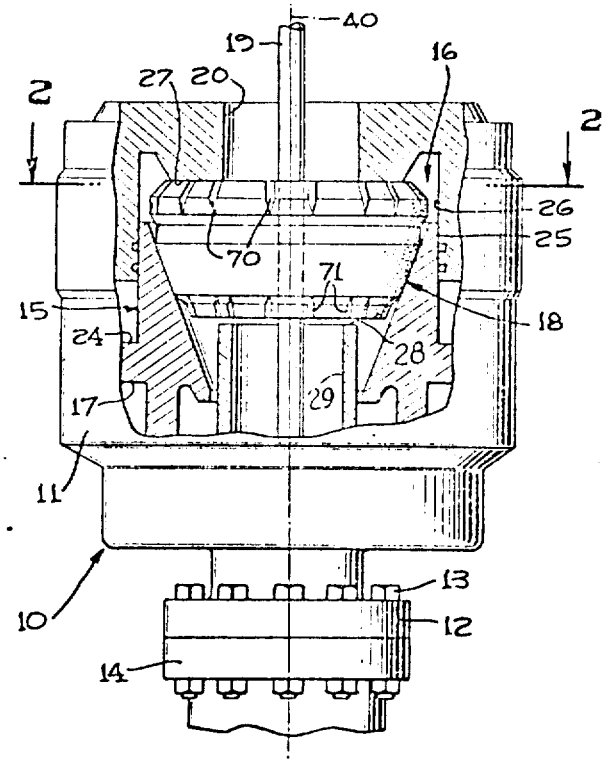

The drawings should be deleted and substituted with the attached drawings therefore.

Signed and Sealed this

Fifth Day of April 1977

[SEAL]

*Attest:*

RUTH C. MASON
*Attesting Officer*

C. MARSHALL DANN
*Commissioner of Patents and Trademarks*

Fig. 1.
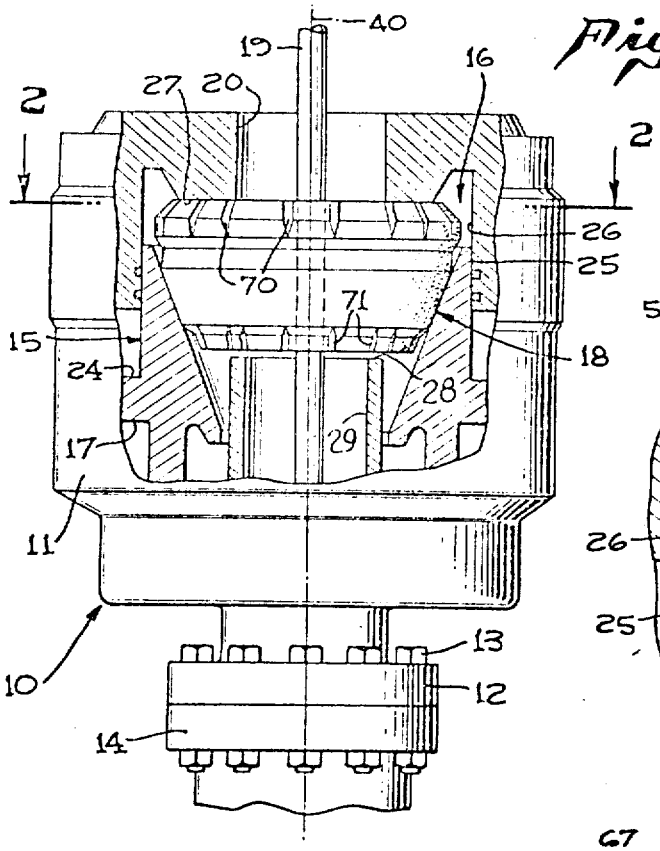
Fig. 8.
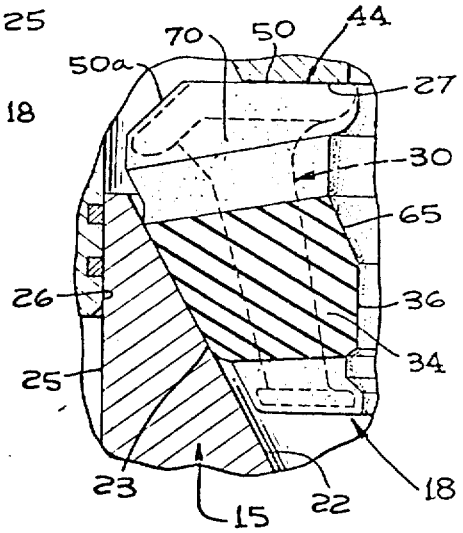
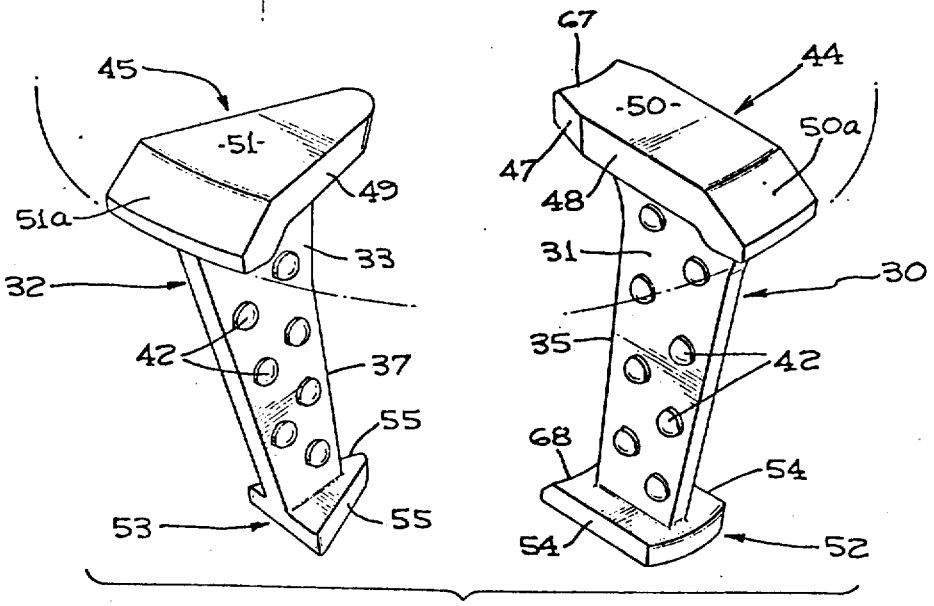
Fig. 9.